US008656611B2

(12) United States Patent
Baucom et al.

(10) Patent No.: US 8,656,611 B2
(45) **Date of Patent: *Feb. 25, 2014**

(54) ARTICLES WITH RETRACTABLE TRACTION ELEMENTS

(75) Inventors: Jim Baucom, Portland, OR (US); Clifford Gerber, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/560,327

(22) Filed: Jul. 27, 2012

(65) Prior Publication Data

US 2012/0291315 A1 Nov. 22, 2012

Related U.S. Application Data

(63) Continuation of application No. 12/566,792, filed on Sep. 25, 2009, now Pat. No. 8,256,145, which is a continuation-in-part of application No. 12/239,190, filed on Sep. 26, 2008, now Pat. No. 8,079,160.

(51) Int. Cl.
*A43C 15/14* (2006.01)

(52) U.S. Cl.
USPC ..... 36/61

(58) Field of Classification Search
USPC ..... 36/61, 134, 127, 128, 59 R
See application file for complete search history.

(56) References Cited

U.S. PATENT DOCUMENTS

| | | | |
|---|---|---|---|
| 303,287 | A | 8/1884 | Hunn |
| 1,361,078 | A | 12/1920 | Lynn |
| 1,559,450 | A | 10/1925 | Oakley |
| 1,736,576 | A | 11/1929 | Cable |
| 2,070,269 | A | 2/1937 | Goldenberg |
| 2,087,945 | A | 7/1937 | Butler |
| 2,090,881 | A | 8/1937 | Wilson |
| 2,095,095 | A | 10/1937 | Howard |
| 2,222,650 | A | 11/1940 | Brady |
| 2,258,734 | A | 10/1941 | Brady |
| 2,853,809 | A | 9/1958 | Bianchi |
| 3,043,026 | A | 7/1962 | Semon |
| 3,063,171 | A | 11/1962 | Hollander |
| 3,352,034 | A | 11/1967 | Braun |
| 3,487,563 | A | 1/1970 | Austin |
| 3,619,916 | A | 11/1971 | Neri |

(Continued)

FOREIGN PATENT DOCUMENTS

| | | |
|---|---|---|
| CA | 2526727 | 5/2007 |
| CN | 101951799 A | 1/2011 |

(Continued)

OTHER PUBLICATIONS

Partial Search Report for PCT/US2009/058522 dated Mar. 4, 2010.

(Continued)

*Primary Examiner* — Ted Kavanaugh
(74) *Attorney, Agent, or Firm* — Banner & Witcoff, Ltd.

(57) ABSTRACT

Articles of manufacture and articles of wear may include one or more traction elements. Portions of the traction elements may be extendable and/or retractable. The traction elements have at least a two-plate construction that is designed to moderate a force that is applied to one of the plates. This construction may be used in articles of footwear having cleats or other traction elements. A force applied by a wearer's foot may be moderated by the two-plate construction.

13 Claims, 18 Drawing Sheets

(56) References Cited

U.S. PATENT DOCUMENTS 3,631,614 A 1/1972 Rice
3,775,874 A 12/1973 Bonneville
3,951,407 A 4/1976 Calacurcio
4,085,527 A 4/1978 Riggs
4,146,979 A 4/1979 Fabbrie
4,223,459 A 9/1980 Riggs
4,271,608 A 6/1981 Tomuro
4,375,728 A 3/1983 Dassler
4,375,729 A * 3/1983 Buchanen, III ..... 36/61
4,378,643 A 4/1983 Johnson
4,402,145 A 9/1983 Dassler
4,439,936 A 4/1984 Clarke et al.
4,466,205 A 8/1984 Corbari
4,546,559 A 10/1985 Dassler
4,562,651 A 1/1986 Frederick et al.
4,633,600 A 1/1987 Dassler et al.
4,667,425 A 5/1987 Effler et al.
4,674,200 A 6/1987 Sing
4,715,133 A 12/1987 Hartjes et al.
4,821,434 A 4/1989 Chein
4,825,562 A 5/1989 Chuang
4,833,796 A 5/1989 Flemming
4,873,774 A 10/1989 Lafever
5,024,007 A 6/1991 DuFour
5,221,379 A 6/1993 Nicholas
5,289,647 A 3/1994 Mercer
5,299,369 A 4/1994 Goldman
5,351,422 A 10/1994 Fitzgerald
5,367,791 A 11/1994 Gross et al.
5,410,823 A 5/1995 Iyoob
5,513,451 A 5/1996 Kataoka et al.
5,524,364 A 6/1996 Cole et al.
5,526,589 A 6/1996 Jordan
5,634,283 A 6/1997 Kastner
5,678,328 A 10/1997 Schmidt et al.
5,775,010 A 7/1998 Kaneko
5,786,057 A 7/1998 Lyden et al.
5,806,209 A 9/1998 Crowley et al.
5,815,951 A 10/1998 Jordan
5,843,268 A 12/1998 Lyden et al.
5,906,872 A 5/1999 Lyden et al.
5,915,820 A 6/1999 Kraeuter et al.
5,943,794 A 8/1999 Gelsomini
5,946,828 A 9/1999 Jordan et al.
5,956,871 A 9/1999 Korsen
5,979,083 A 11/1999 Robinson et al.
5,983,529 A 11/1999 Serna
6,029,377 A * 2/2000 Niikura et al. ..... 36/67 R
6,035,559 A 3/2000 Freed et al.
6,058,627 A 5/2000 Violette et al.
6,076,283 A 6/2000 Boie
6,079,127 A 6/2000 Nishimura et al.
6,112,433 A 9/2000 Greiner
6,119,373 A 9/2000 Gebhard et al.
6,125,556 A 10/2000 Peckler et al.
6,161,315 A 12/2000 Dalton
6,256,907 B1 7/2001 Jordan et al.
6,354,022 B2 3/2002 Gelsomini
6,357,146 B1 3/2002 Wordsworth et al.
6,389,714 B1 5/2002 Mack
6,438,873 B1 8/2002 Gebhard et al.
6,474,005 B2 11/2002 Kobayashi
6,477,791 B2 11/2002 Luthi et al.
6,481,122 B2 11/2002 Brahler
6,550,160 B2 4/2003 Miller, II
6,615,512 B2 9/2003 Sink
6,647,647 B2 11/2003 Auger et al.
6,658,766 B2 12/2003 Kraeuter et al.
6,665,961 B2 12/2003 Kobayashi et al.
6,675,505 B2 1/2004 Terashima
6,698,110 B1 3/2004 Robbins
6,739,075 B2 5/2004 Sizemore
D495,122 S 8/2004 McMullin
6,834,446 B2 12/2004 McMullin
6,857,205 B1 2/2005 Fusco et al.
6,904,707 B2 6/2005 McMullin
6,915,595 B2 7/2005 Kastner
6,915,596 B2 7/2005 Grove et al.
6,920,705 B2 7/2005 Lucas et al.
6,941,684 B2 9/2005 Auger et al.
6,948,264 B1 9/2005 Lyden
7,007,410 B2 3/2006 Auger et al.
830,324 A1 9/2006 Hunt
7,124,519 B2 10/2006 Issler
7,143,530 B2 12/2006 Hudson et al.
7,194,826 B2 3/2007 Ungari
7,234,250 B2 6/2007 Fogarty et al.
7,243,445 B2 7/2007 Manz et al.
7,254,909 B2 8/2007 Ungari
7,269,916 B2 9/2007 Biancucci et al.
7,287,343 B2 10/2007 Healy
7,370,439 B1 5/2008 Myers
7,386,948 B2 6/2008 Sink
7,406,781 B2 8/2008 Scholz
7,409,783 B2 8/2008 Chang
7,430,819 B2 10/2008 Auger et al.
7,490,418 B2 2/2009 Obeydani
7,523,566 B2 4/2009 Young-Chul
7,559,160 B2 7/2009 Kelly
7,584,554 B2 9/2009 Fogarty et al.
7,654,013 B2 2/2010 Savoie et al.
7,784,196 B1 8/2010 Christensen et al.
7,818,897 B2 10/2010 Geer
7,954,257 B2 6/2011 Banik
8,079,160 B2 12/2011 Baucom et al.
8,122,617 B1 2/2012 Dixon et al.
8,256,145 B2 9/2012 Baucom
8,356,428 B2 1/2013 Auger et al.
8,453,349 B2 * 6/2013 Auger et al. ..... 36/59 R
2001/0005947 A1 7/2001 Sordi
2002/0017036 A1 2/2002 Berger et al.
2002/0062578 A1 5/2002 Lussier et al.
2002/0078603 A1 6/2002 Schmitt, Jr.
2002/0100190 A1 8/2002 Pellerin
2003/0033731 A1 2/2003 Sizemore
2003/0188458 A1 10/2003 Kelly
2004/0035024 A1 2/2004 Kao
2004/0163282 A1 8/2004 Pan
2004/0187356 A1 9/2004 Patton
2004/0250451 A1 12/2004 McMullin
2005/0072026 A1 4/2005 Sink
2005/0217149 A1 10/2005 Ho
2005/0257405 A1 11/2005 Kilgore
2005/0268490 A1 12/2005 Foxen
2006/0016101 A1 1/2006 Ungari
2006/0021254 A1 2/2006 Jones
2006/0130372 A1 6/2006 Auger et al.
2006/0242863 A1 11/2006 Patmore
2007/0261271 A1 11/2007 Krouse
2008/0066348 A1 3/2008 O'Brien et al.
2008/0072457 A1 3/2008 Shakoor et al.
2008/0196276 A1 8/2008 McMullin
2008/0216352 A1 9/2008 Baucom et al.
2008/0271341 A1 11/2008 Amark
2009/0056172 A1 3/2009 Cho
2009/0100716 A1 4/2009 Gerber
2009/0100718 A1 4/2009 Gerber
2009/0126230 A1 5/2009 McDonald et al.
2009/0223088 A1 9/2009 Krikorian et al.
2009/0241370 A1 10/2009 Kimura
2009/0249648 A1 10/2009 Brown et al.
2009/0307933 A1 12/2009 Leach
2009/0313856 A1 12/2009 Arizumi
2010/0005684 A1 1/2010 Nishiwaki et al.
2010/0024250 A1 2/2010 Fogarty et al.
2010/0050475 A1 3/2010 Benz et al.
2010/0077635 A1 4/2010 Baucom et al.
2010/0083539 A1 4/2010 Norton
2010/0083541 A1 4/2010 Baucom et al.
2010/0212190 A1 8/2010 Schmid
2010/0251578 A1 10/2010 Auger et al.
2010/0313447 A1 12/2010 Becker et al.
2011/0047830 A1 3/2011 Francello et al.
2011/0078927 A1 4/2011 Baker

(56) References Cited

U.S. PATENT DOCUMENTS

| | | | |
|---|---|---|---|
| 2011/0126426 | A1 | 6/2011 | Amark |
| 2011/0146110 | A1 | 6/2011 | Geer |
| 2011/0192056 | A1 | 8/2011 | Geser et al. |
| 2011/0197478 | A1 | 8/2011 | Baker |
| 2011/0203136 | A1 | 8/2011 | Auger |
| 2012/0036740 | A1 | 2/2012 | Gerber |

FOREIGN PATENT DOCUMENTS

| | | |
|---|---|---|
| DE | 930798 | 7/1955 |
| DE | 2927635 | 1/1981 |
| DE | 3046811 | 7/1982 |
| DE | 3245182 | 5/1983 |
| DE | 3600525 | 10/1987 |
| DE | 3703932 | 8/1988 |
| DE | 3644812 | 9/1988 |
| DE | 102008033241 | 11/2009 |
| EP | 0223700 | 5/1987 |
| EP | 0723745 | 7/1996 |
| EP | 0890321 | 1/1999 |
| EP | 965281 | 12/1999 |
| EP | 1106093 | 6/2001 |
| EP | 1234516 | 8/2002 |
| EP | 1369049 | 12/2003 |
| EP | 1714571 | 10/2006 |
| EP | 1839511 | 10/2007 |
| EP | 2014186 | 1/2009 |
| EP | 2057913 | 5/2009 |
| EP | 2286684 | 2/2011 |
| EP | 2305056 | 4/2011 |
| EP | 2319342 | 5/2011 |
| FR | 2567004 | 1/1986 |
| FR | 2608387 | 6/1988 |
| FR | 2775875 | 9/1999 |
| FR | 2818876 | 7/2002 |
| GB | 2340378 | 2/2000 |
| JP | 8214910 | 8/1996 |
| JP | 10000105 | 6/1998 |
| JP | 2000236906 | 9/2000 |
| JP | 2002142802 | 5/2002 |
| JP | 2003284605 | 10/2003 |
| JP | 2006198101 | 8/2006 |
| TW | 540323 U | 7/2003 |
| TW | M267886 U | 6/2005 |
| WO | 9807341 | 2/1998 |
| WO | 9820763 | 5/1998 |
| WO | 0053047 | 9/2000 |
| WO | 03071893 | 9/2003 |
| WO | 2006103619 | 10/2006 |
| WO | 2007138947 | 12/2007 |
| WO | 2008069751 | 6/2008 |
| WO | 2008128712 | 10/2008 |
| WO | 2009110822 | 9/2009 |
| WO | 2010036988 | 4/2010 |
| WO | 2010057207 | 5/2010 |
| WO | 2012150971 | 11/2012 |

OTHER PUBLICATIONS

International Search Report and Written Opinion of PCT/US2010/029640 dated May 17, 2010.

International Search Report and Written Opinion of PCT/US2009/058522 dated Feb. 17, 2010.

International Search Report and Written Opinion for PCT/US2010/050637 dated Jan. 14, 2011.

International Search Report and Written Opinion for PCT/US2011/022841 dated Apr. 15, 2011.

International Search Report and Written Opinion for PCT/US2011/022848 dated Jun. 20, 2011.

Aug. 12, 2010, Icebug web page (date based on information from Internet Archive).

Dec. 23, 2008, Icebug web page (date based on information from Internet Archive).

International Search Report and Written Opinion for PCT/US2011/045356 dated Dec. 16, 2011.

International Preliminary Report on Patentability (including Written Opinion of the ISA mailed May 3, 2012 in International Application No. PCT/US2010/053340.

Wiki(Boot)Leaks: adiZero II & adipure11Pro—More Info!, dated Jun. 22, 2011, accessed Aug. 25, 2011. http://www.soccerreviews.com.

Invitation to Pay Additional Fees mailed May 4, 2011 in International Application No. PCT/US2010/053340.

International Search Report and Written Opinion mailed Aug. 12, 2011 in International Application No. PCT/US2010/053340.

First Office Action in CN200980137560.9 dated Feb. 8, 2013.

* cited by examiner

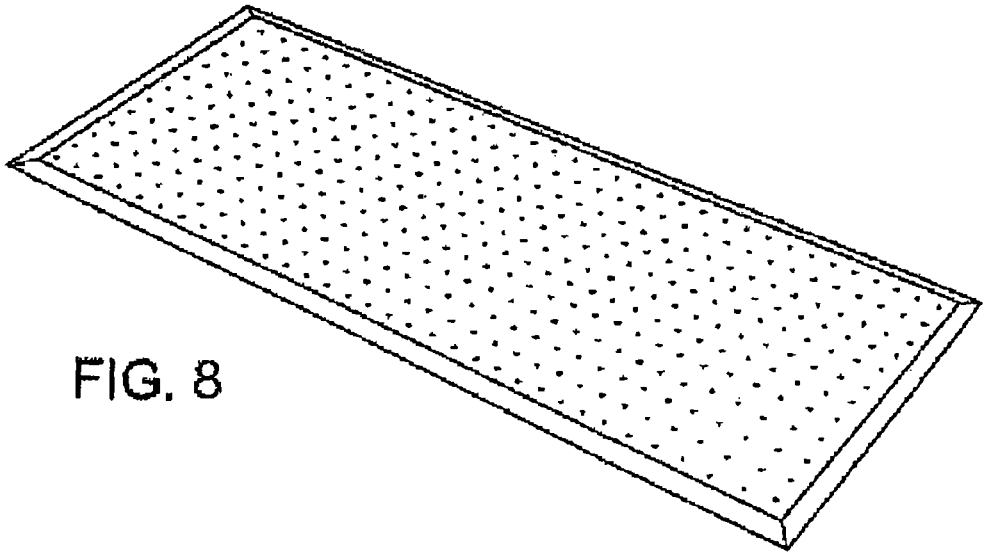
FIG. 8
FIG. 9
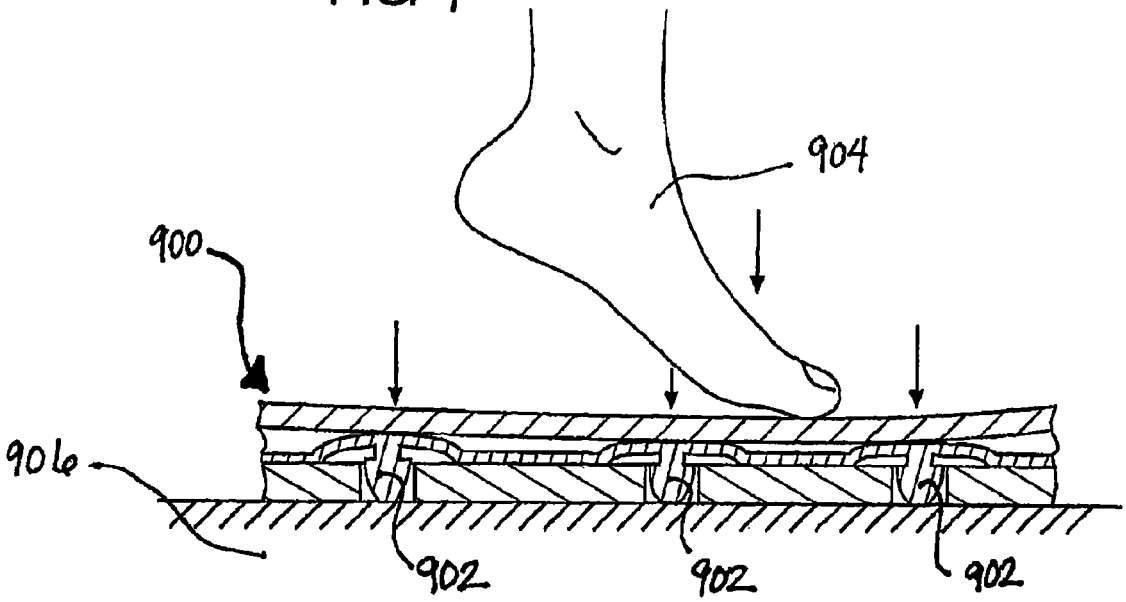

ARTICLES WITH RETRACTABLE TRACTION ELEMENTS

CROSS-REFERENCE TO RELATED APPLICATION

This application is a continuation of U.S. patent application Ser. No. 12/566,792, filed Sep. 25, 2009 (now U.S. Pat. 8,256,145), and entitled "Articles with Retractable Traction Elements," which application is a continuation-in-part of U.S. patent application Ser. No. 12/239,190 (now U.S. Pat. 8,079,160), filed Sep. 26, 2008 and entitled "Articles with Retractable Traction Elements." application Ser. Nos. 12/566,792 and 12/239,190, in their entirety, are incorporated by reference herein.

FIELD OF THE INVENTION

Aspects of the invention relate generally to traction elements for articles of manufacture and articles of wear such as footwear, apparel, and athletic or protective gear. More specifically, aspects of the invention relate to fraction elements for articles of manufacture that are dynamically extendable and retractable.

BACKGROUND

Many articles of wear benefit from traction elements. Such articles of wear usually come into contact with a surface or another item and benefit from the increased friction and stability provided by the traction elements. Many people wear footwear, apparel, and athletic and protective gear and expect these articles of wear to provide fraction and stability during use. For example, articles of footwear may include traction elements that are attached to the ground contacting surface of a sole structure. The traction elements may provide gripping characteristics that help create supportive and secure contact between the wearer's foot and the ground.

Most traction elements are attached to the ground contacting surface of an article of wear. Such traction elements are often rigid and provide a single type and quantity of traction. These traction elements do not respond to the evolving needs of the user nor do they respond to the inherent physiological differences between users. These traction elements may tend to wear unevenly and frequently need to be repaired and/or replaced, which can be expensive and time-consuming.

Some traction elements may be detachable and an article of wear may be capable of receiving several different types, sizes, and characteristics of traction elements (e.g., track spikes may be detachable from the article of footwear and replaceable with longer spikes, e.g., for use on different surfaces and/or different weather conditions). However, removing a first type of traction element and attaching a second type of traction element is time-consuming and inconvenient. Many wearers cannot afford the time that it takes to replace traction elements during use and/or the costs associated with replacing the traction elements. Additionally, many wearers need traction elements that can respond to the motion of the article of wear during use.

For example, the traction elements attached to an article of footwear may not be able to respond to the typical motion that a wearer's foot may undergo during use. An athlete may wish to stop abruptly, turn, pivot, and rock onto the medial or lateral edges of the foot and thus the athlete would benefit from traction elements that dynamically respond to these motions. Further, the athlete also may wish to have traction reduced during normal activity, such as running, walking, or standing, e.g., in order to avoid excessive wear of the traction elements and/or damage to a surface. Most of the traction elements currently available are unable to provide the varying amounts of traction during various activities without requiring manual detachment and reattachment of the traction elements.

Therefore, while some traction elements are currently available, there is room for improvement in this art. For example, an article of wear having traction elements that may be dynamically extendable and retractable, depending on the force applied to the article of wear, while remaining comfortable and flexible for the user would be a desirable advancement in the art. Additionally, traction elements that protect against wear and that dynamically retract and extend in response to a force would also be welcomed in the art.

When wearers insert their feet into footwear having traction elements, they can oftentimes "feel" the pressure of the traction elements on the bottom of their feet through the insole of the footwear. Most athletes playing sports that require footwear with traction elements prefer that the footwear is lightweight and aerodynamic. To meet these needs of the wearers, many footwear manufacturers have developed sole structures that incorporate only essential elements and do not include bulky cushioning, especially not in the insole. This construction and other reasons cause the pressure from the traction elements to be felt by the wearers through the insole surface. Therefore, footwear with traction elements that can moderate the pressure from the traction element(s) would be a welcomed advancement in the art.

SUMMARY

The following presents a general summary of aspects of the invention in order to provide a basic understanding of at least some of its aspects. This summary is not an extensive overview of the invention. It is not intended to identify key or critical elements of the invention and/or to delineate the scope of the invention. The following summary merely presents some concepts of the invention in a general form as a prelude to the more detailed description provided below.

Aspects of this invention relate to articles of wear, such as footwear, athletic or protective equipment, and apparel, having traction elements. In an aspect, retractable fraction elements may be included in articles of footwear. The article of footwear may comprise an upper, a sole member, and a plurality of traction elements. The sole member may be attached to the upper and the sole member may have a plurality of openings. The plurality of traction elements may be provided within or attached at least to the sole member and may be capable of dynamically extending from a first position to a second position and then retracting from the second position to the first position. A first portion of the plurality of traction elements may include a ground-contacting element and an extension inducing element. The extension inducing element may be capable of operationally engaging the ground-contacting element so that it may move from the first position to the second position and extend through one of the openings in the sole member and engage with a surface.

Additional aspects of this invention relate to traction elements for articles of manufacture and articles of wear. The traction elements may comprise a first extension inducing element and a first ground-contacting element attached to the first extension inducing element. The traction element also may comprise a second extension inducing element and a second ground-contacting element that may be attached to the second extension element. The traction element also may include a base member that may interconnect the first extension inducing element and the second extension inducing element. The first extension inducing element and the second extension inducing element may be capable of inducing their respective ground-contacting element to extend from a first position to a second position in response to an application of force on the first extension inducing element and the second extension inducing element. The ground-contacting elements may retract when the applied force is lessened or released.

Still additional aspects of the invention relate to methods of providing traction for articles of manufacture. The method may comprise applying a force to a traction element, the traction element having an extension inducing element and a ground-contacting element. The extension inducing element may be attached to and operationally engaged with the ground-contacting element. The ground-contacting element may be caused to dynamically extend through an opening in a base element of an article of manufacture in response to the application of force to the fraction element. The ground-contacting element may be dynamically extended from a first retracted position to a second extended position. The ground-contacting element may be caused to engage with a surface when the traction element is in the second position. As noted above, the ground-contacting element will retract when the applied force is lessened or released.

In still additional aspects of the invention, a fraction element may comprise at least two plates, an extendable portion, and a plunger. The at least two plates may include a first plate that is positioned approximately parallel to a second plate. A space is defined between the first plate and the second plate. The extendable portion may be attached to or integrally formed with the first plate. The plunger may be attached to or integrally formed with the second plate so that the plunger is aligned with the extendable portion. When a force is applied to the second plate, the plunger may cause the extendable portion to extend from a first, retracted position to a second, extended position. Refraction to the first position occurs when the force is removed or lessened. This traction element may be attached to a sole base member to comprise a sole structure. The sole structure may be incorporated into an article of footwear comprising an upper, a sole structure attached to the upper, and at least one of the traction elements described above.

In yet another aspect of the invention, a traction element may comprise at least two plates, an extendable portion, and a plunger. The at least two plates may include a first plate that is positioned approximately parallel to a second plate. A space may be defined between the first plate and the second plate. The extendable portion may be attached to or integrally formed with the first plate. The plunger may be attached to or integrally formed with the second plate so that the plunger is aligned with the extendable portion. The first plate and the second plate may be spaced apart a first distance when the extendable portion is in a first, retracted position and the first plate and the second plate may be spaced apart a second distance when the extendable portion is in a second, extended position. The first distance may be greater than the second distance. This traction element may be attached to a sole base member to comprise a sole structure. The sole structure may be incorporated into an article of footwear comprising an upper, a sole structure attached to the upper, and at least one of the traction elements described above.

In still another aspect of the invention, a traction element may comprise a first plate having a plunger protruding therefrom, a second plate positioned approximately parallel to the first plate, an extendable portion attached to or integrally formed with the second plate, and a protrusion extending away from the first surface of the second plate. A space may be defined between the first plate and the second plate. The second plate may have a first surface and a second, opposing surface. The protrusion that may be attached to the second plate also may be spaced apart from the extendable portion. In response to a force applied to the first plate, the plunger may apply a force to the second surface of the second plate to cause the extendable portion to flex, which causes the protrusion to extend from a first, retracted position to a second, extended position. Relaxation or release of the force will cause the protrusion to retract to the first position. This traction element may be attached to a sole base member to comprise a sole structure. The sole structure may be incorporated into an article of footwear comprising an upper, a sole structure attached to the upper, and at least one of the traction elements described above.

BRIEF DESCRIPTION OF THE DRAWINGS

A more complete understanding of the present invention and certain advantages thereof may be acquired by referring to the following description along with the accompanying drawings, in which like reference numbers indicate like features, and wherein:

FIG. 8 illustrates a mat containing a plurality of traction elements, according to aspects of the invention.

FIG. 9 illustrates a user's foot engaging a mat having a plurality of traction elements according to an aspect of the invention.

Figures 1A, 1B:
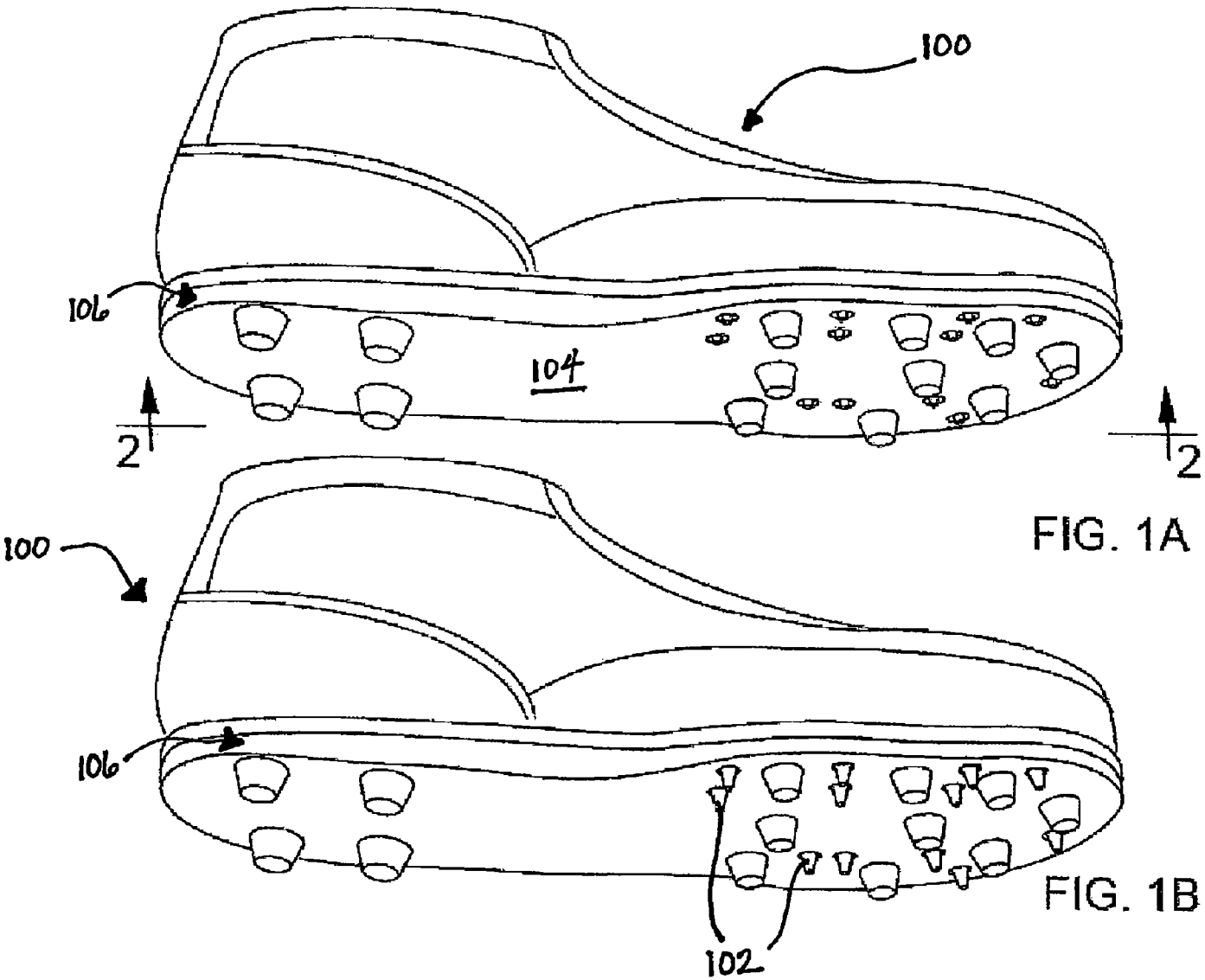
FIGS. 1A and 1B illustrate a plurality of retractable traction elements embodied in an article of footwear, in accordance with an aspect of the invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

A. General Description of Articles with Retractable Traction Elements According to Examples of the Invention In general, as described above, aspects of the invention relate to retractable traction elements. In accordance with at least some aspects of the invention, retractable traction elements may be embodied in an article of footwear that includes: (a) an upper; (b) a sole member engaged with the upper, the sole member having a plurality of openings; and (c) a plurality of retractable traction elements capable of dynamically extending from a first position to a second position, wherein at least some of the plurality of retractable traction elements include a ground-contacting element and an extension inducing element, the extension inducing element capable of operationally engaging the ground-contacting element to extend through one of the openings when at least one of the traction elements is positioned in the second position.

The retractable traction elements may be included in any article of manufacture or article of wear. An article of manufacture may be any item or product that may be made by hand or by machine and may include items such as protective gear and athletic equipment. An article of wear may include any item that may be worn, such as articles of apparel and articles of footwear.

As a more specific example, an article of wear in accordance with at least some examples of this invention may include an article of footwear. The article of footwear may include an upper and a sole member. For reference purposes only, the article of footwear may be divided into three general regions: a forefoot region, a midfoot region, and a heel region. The article of footwear also may include a lateral side and a medial side. The lateral side may reference the side of the article of footwear that is farthest away from the center axis of the user's body. The medial side may reference the side of the article of footwear that is nearest the center axis of the user's body. The lateral side and the medial side may reference opposing sides of the article of footwear.

The forefoot region may correspond with the portion of the article of footwear that may be capable of receiving and/or housing the metatarsals and phalanges (the toes and corresponding joint bones). The midfoot region may correspond with the arch area of the foot, and the heel region may correspond with the rear portion of the foot, including the calcaneous bone. The forefoot region, the midfoot region, and the heel region are intended to represent general areas of the article of footwear to aid in the following discussion and are not intended to demarcate precise areas of the article of footwear. The forefoot region, the midfoot region, and the heel region also may correspond to the sole member, the upper, and the individual elements thereof.

The sole member may be attached to the upper and may be positioned between the upper and the ground when the article of footwear is worn. The sole member may help provide traction and may attenuate impact forces when the sole member engages with the ground during wear such as walking, running, or other activities that cause the sole member to engage with a surface.

One example structure for an article of footwear may be an upper and a sole member having an outsole, a midsole, and an insole. The midsole may be secured to the lower portion of the upper and may be primarily formed from a polymer foam element (e.g., a polyurethane or ethylvinylacetate foam, phylon, phylite, etc.). The outsole may be secured to the lower/outer surface of the midsole and may be formed from textured rubber or other materials that impart a relatively high degree of wear resistance and/or traction properties.

The insole may be positioned within the upper and may extend along at least a portion of the longitudinal length of the sole member (i.e., along the length of the midsole and/or the outsole). The insole may extend along a portion or all of the interior surface of the midsole (i.e., the midsole surface that faces the interior of the upper). The insole may be positioned to extend beneath the forefoot region, the midfoot region, and/or the heel region of the wearer's foot. Although this configuration may be a suitable example sole member and upper combination, a variety of other combinations and configurations of the upper and the sole member may be utilized without departing from the present invention. For example, an article of footwear need not include either or both of an insole or an outsole or may include interchangeable insoles and/or outsoles.

The upper of the article of footwear may define a void for receiving a user's foot and for securing the article of footwear to the user's foot. The void may be shaped to accommodate a foot and may extend along the lateral side of the foot, along the medial side of the foot, over the in step of the foot, and/or under the foot. The article of footwear may be any suitable design including, but not limited to an athletic shoe, a hiking boot, a water shoe, a sandal, or the like.

Access to the void generally is provided by an ankle opening that may be located at or near the heel region of the article of footwear. A securing element may help secure the article of footwear to the wearer's foot and may accommodate feet of varying sizes and shapes. The securing element may permit the wearer to loosen the attachment of the article of footwear to the wearer's foot to facilitate removal. The securing element may be any suitable form, including a lace configuration, a hook and loop configuration, elastic, straps, zippers, buttons, buckles, mechanical connectors, or any other suitable securing mechanism.

As discussed above, the sole member may be attached to the upper and may have a plurality of openings. Traction elements may be attached to or included within the sole member and may be capable of dynamically extending from a first (retracted) position to a second (extended) position through the openings (and vice versa). The openings may be shaped to receive the traction elements and optionally to slidingly engage the traction elements as they move from the first position to the second position. The openings may be any suitable shape and may oftentimes be a complementary shape to the shape of the traction elements (i.e., the traction elements are conically or cylindrically shaped and the openings are round or cylindrically shaped).

The edges of the openings may be straight, rounded, beveled, or any other suitable shape that permits the traction elements to easily move through and/or slide along the opening. In one example, the edges of the openings may slidingly engage with a portion of the traction element when it moves from the first position to the second position. The edge of the openings may be slightly rounded to facilitate easy sliding of the retractable traction element against the interior surface and edge of the opening. If desired, a cover element (such as a slitted plastic sheet) may cover the openings, to help prevent dirt, mud, or other debris from entering the openings.

The traction elements may be attached to the sole member in any suitable fashion. For example, the traction elements may be fixedly attached to the sole member by adhesive, molding, or the like. The fraction elements and the sole member may be of a unitary construction. The traction elements may be detachable from the sole member via any suitable configuration such as mechanical connectors and thread and screw arrangements.

The traction elements may be attached to at least the sole member. In some examples, the sole member comprises an outsole, a midsole, and an insole. The traction elements may be attached to any portion of the article of footwear. For example, the traction elements may be attached to and/or located between the outsole and/or the midsole. In other examples, the fraction elements may be attached to and/or located between the sole member and the upper.

In one example, a first portion of the traction elements may be attached to or included as part of the midsole of the sole member and may extend through corresponding openings provided in the outsole (e.g., a plate member) to engage the ground during use. The first portion of the traction elements may be retractable or may be non-retractable.

For example, a plurality of primary, non-retractable traction elements may be attached to the outsole of the sole member and may be optionally removable. Secondary, retractable traction elements may be positioned to extend along a medial portion and a lateral portion of the forefoot region of the article of footwear. The primary, non-retractable traction elements may be positioned along the forefoot region, the midfoot region, and the heel region of the outsole.

The primary traction elements may be retractable or non-retractable. The secondary traction elements may be retractable or non-retractable. The term "primary" may relate to a portion of the fraction elements that may experience the most force during the athlete's motions. The term "secondary" may relate to a portion of the traction elements that engages when the athlete performs a particular motion. In some examples, both the primary traction elements or a portion thereof and the secondary traction elements or a portion thereof may be retractable. In such an example embodiment, the primary traction elements may have different properties than the secondary traction elements.

The retractable and the non-retractable traction elements may be positioned in any desired configuration. For example, a medial group of the primary traction elements may be grouped together and may extend longitudinally along the length of the forefoot region of the outsole, at or near the medial edge. A lateral group of primary traction elements may be grouped together and may extend along the length of the forefoot region of the outsole, at or near the lateral edge.

The motion of a wearer's foot during normal use may cause the application of force to the medial and/or the lateral edges of the sole member as it engages with a surface. For example, this type of force application may occur as a result of the pivot action of a foot when a user changes direction or any other action that causes the wearer's foot to supinate and/or pronate. For example, a normal walking cycle comprises a pronation phase, a supination phase, and a swing phase. During the pronation phase, the heel region of the wearer's foot strikes the ground or surface, and the leg is extended in a direction usually toward the direction in which the wearer is walking The strike of the heel region against the ground includes a forward, horizontal force that slows the body's forward motion and a downward, vertical force that absorbs and controls the body's downward motion and stabilizes the body's balance as it engages with the ground or surface.

Generally, the body's center of gravity moves forward after the pronation or striking phase and shifts into a supination or propulsion phase. The supination phase includes little or no vertical force and a horizontal force that is directed in the direction opposite of the wearer's movement (i.e., if the wearer wishes to travel forward, the horizontal force is directed behind the wearer). During this transition, the force extends from the heel region of the wearer's foot through the lateral portion of the midfoot region and into both the lateral and medial areas of the forefoot region. Force may be exerted from the forefoot region against the ground or surface to lift the wearer's foot (and ultimately the wearer's entire leg) off of the ground and into a swing phase when it rotates around an axis defined by the hip joint and swings through to intersect a coronal plane (generally parallel to a sagittal plane) to begin a new walking cycle. Similar phases are experienced when the wearer runs, jogs, or the like.

During the supination, pronation, and swing phases described above, the same or similar points along the sole member may repeatedly engage with the ground or surface. The various portions of the retractable traction elements may be positioned within the heel region and the forefoot region of the sole member to provide the wearer with maximum stability and traction as the sole member engages with the ground or surface.

Primary traction elements may be positioned within any region or point of contact between the sole member and the ground or surface that are described above. However, they may provide the greatest traction characteristics when strategically placed in the regions and the positions that are most likely to endure most of the force during the supination, pronation, and swing phases (i.e., the contact points along the sole member that engage the ground or surface during the supination and pronation phases, as discussed above).

Primary traction elements may be attached to the outsole in any desired configuration, as discussed above. For example, the primary fraction elements may be positioned in the forefoot region and within the heel region of the outsole. A first group of primary traction elements may be positioned near, adjacent to, or mingled among secondary traction elements, which will be discussed in greater detail below.

The positioning of each of the retractable traction elements and the non-retractable traction elements may be in any suitable configuration. Many of the retractable traction elements may be positioned at areas of the sole member that experience a high quantity of force and/or may benefit from additional traction during specific motions. Some common activities may include the user pivoting, spinning, changing direction of motion, running, jumping, walking, or the like. In many examples, the retractable traction elements may not be located within the midfoot region of the article of footwear, but rather may be concentrated within the forefoot region and/or the heel region of the article of footwear. These regions may receive most of the impact when an article of footwear may be in use, particularly in some of the direction change, backpedaling, and/or other activities described above.

In another example, the retractable traction elements may be positioned along a medial portion and a lateral portion of the forefoot region of the sole member. A plurality of the retractable traction elements may be interconnected by a base member or a plate that may be positioned within a lateral area or along a lateral edge within the forefoot region of the sole member. Likewise, a plurality of the retractable traction elements may be interconnected by a base member that may be positioned within a medial area or along a medial edge within the forefoot region of the sole member. The retractable traction elements positioned in the lateral area may operate independent from the retractable fraction elements positioned in the medial area. Further, the retractable traction elements in the lateral area and in the medial area may define distinct and discrete inserts or elements that may be attached to or otherwise engaged with the sole member between the midsole or insole and the outsole.

The retractable traction elements may include a ground-contacting element and an extension inducing element. The extension inducing element may be capable of operationally engaging the ground-contacting element, forcing it to selectively extend from a first position to a second position. A force may be applied to the extension inducing element during the normal course of a user's activity, such as walking, jogging, running, or the like. As explained in detail above, a user of an article of footwear may apply a force to the heel region, the midfoot region, and the forefoot region of the sole member of the article of footwear as the foot moves through the supination, pronation, and swing phases of a step.

Specifically, in some steps and during some movement activities, greater force may be applied to the sole member in the heel region and in areas along the medial edge and/or the lateral edges of the forefoot region of the sole member. A plate or insert including a plurality of secondary or retractable traction elements may be positioned along the medial edge area and/or along the lateral edge area of the sole so that the retractable traction elements may be selectively and dynamically extended and retracted during the normal motion of a user's activity.

For example, the extension inducing element of the retractable traction elements may be capable of receiving a force from a user (e.g., as a result of a step down or foot plant) that may cause the sole member to engage with the ground or surface, such as during running, walking, pivoting, or the like. The force may be received by the extension inducing element and may cause the extension inducing member to flex. In one example, the extension inducing element may be a dome shape. When a force is applied to the dome shape, it flexes so that its crest extends toward the ground or surface in a spring-like motion. The material and shape of the extension inducing member may be such that the member deforms under an exerted force and "springs back" to its original shape when the force is relieved or removed.

Given the nature of a dome shape, a force applied anywhere along the surface of the dome may cause the dome to flex and have a spring-like effect. The intensity of the force (and thus the spring-like effect of the dome structure) varies based on the angle at which the force engages or contacts the dome. A force engaging the dome near the dome's crest may result in a more intense extension, whereas a force engaging the dome near its edge may result in a less forceful extension (or may be insufficient to cause the dome to flex).

In another example, the extension inducing element may be a leaf spring having an elliptical or otherwise raised top surface extending away from a flat or base surface, such as an insert, and having two side areas. In many examples, the side areas may be holes (or voids) and may allow the elliptical top surface to extend beyond the plane defined by the flat surface. The leaf spring may extend to any suitable position or any desired height.

In both of the aforementioned examples, the surface of the extension inducing element may be rounded or partially rounded (e.g., a three dimensional multi-sided polygon) that may be capable of distributing force more evenly throughout the traction element than a flat surface. Although the surface may be any suitable shape, at least some of the example extension inducing members used in structures according to the invention have a rounded or curved surface.

The extension inducing elements may be positioned in a retracted position when force is not being applied thereto and thus the retractable traction element may be suspended above the ground or surface. For example, the retractable traction elements may be positioned in a retracted position until a force causes them to selectively extend from a first, retracted position to a second, extended position, e.g., such as when users step on the sides of their foot when making a turn or cut, when a golfer's weight shifts over the course of a golf swing, etc.

The non-retractable traction elements (e.g., primary traction elements) may be static with respect to a force being applied to the sole structure or the secondary traction elements. The non-retractable traction elements may form at least a portion of the ground contacting surface of the sole member, and these non-retractable traction elements may engage the ground or surface each time the sole member engages the ground or surface.

In contrast, the retractable traction elements engage the ground only when a sufficient force is applied to the extension inducing element. These retractable traction elements may extend through openings in the sole structure from the first, retracted position to the second, extended position in response to the force. This configuration may permit the retractable traction elements to respond and provide traction for targeted areas of the sole member and in response to specific movements executed by the user without weighing down the article of footwear, with larger heavier non-retractable fraction elements and without causing unnecessary difficulties during the supination, pronation, and swing phases of the normal step cycle.

The ground-contacting element may be attached to the extension inducing element and may be operationally engaged or activated by the extension inducing element. The ground-contacting element may include any suitable material, including the same material as the extension inducing element. The ground-contacting element may be engaged with or operatively coupled to the extension inducing element by any suitable attachment mechanism and in any suitable position on the extension inducing element. For example, the ground-contacting element may be attached to the extension inducing element at or near the crest of the interior surface of the dome configuration and/or the leaf spring configuration.

The ground-contacting element may be any suitable shape and/or size. For example, a portion of the ground-contacting element may be conical or cylindrical. Any portion of the body and/or the tip portion of the ground-contacting element may be flattened, rounded, pointed, and/or tapered, depending on the functional needs of the user or wearer. In one example, the ground-contacting element may have a cylindrical shape through its body that may taper to a cone-shaped end portion or a rounded or flattened end surface. In another example, the ground-contacting element may have a plurality of flat sides and a tapered, flattened end portion (e.g., akin to the shape of a conventional baseball spike).

The extension inducing element and the ground-contacting element may function in unison to respond to a force and provide additional traction along the sole member. The retractable traction elements may be dynamically engaged during a step cycle so that the ground-contacting element extends through the openings in the sole member and engages with the ground or surface, as described above. The ground-contacting element may automatically respond to the application of force to the extension inducing element, e.g., in response to a force in a pre-determined direction and/or of a sufficient magnitude, such as when users make a turn and plant their foot on a surface and then subsequently pushes off on the lateral and/or medial side of their foot.

In general, another aspect of the invention relates to traction elements comprising: (a) a plurality of extension inducing elements capable of receiving and transmitting a force; (b) a plurality of ground-contacting elements capable of receiving the force from at least one of the plurality of extension inducing elements, each of the ground-contacting elements in operational engagement with at least one of the extension inducing elements; and (c) a plate interconnecting at least the plurality of extension inducing elements, the plate capable of being attached to an object; wherein at least one of the plurality of ground-contacting elements is capable of extending from a first position at a first distance from the plate to a second position at a second distance from the plate that is greater than the first distance in response to an application of force upon at least one of the extension inducing elements. At least one of the plurality of ground-contacting elements may be arranged so as to be capable of extending through at least one hole in a sole structure from a first position at a first distance from a plate of the sole structure to a second position at a second distance from the plate that is greater than the first distance. The ground-contacting elements may be capable of extending in response to the force.

In general, another aspect of the invention relates to methods of providing traction and may comprise the steps of: (a) applying a force to a traction element, the traction element having an extension inducing element and a surface-contacting element, the extension inducing element operationally engaged with the surface-contacting element; (b) causing the surface-contacting element to extend through an opening in an article of manufacture in response to an application of force to the extension inducing element, the surface-contacting element extending from a first retracted position to a second extended position; (c) causing the surface-contacting element to engage a surface when the traction element is in the second extended position; and/or (d) causing the surface-contacting element to retract to the first retracted position when the force applied to the extension inducing element is released or sufficiently relaxed.

In yet another aspect of the invention, a method of providing traction for an article of manufacture may comprise the steps of: (a) applying force to a traction element, the traction element having an extension inducing element and a ground-contacting element, the extension inducing element operationally engaged with the ground-contacting element; (b) causing the ground-contacting element to extend through an opening in a base member structure in response to the application of force to the traction element, the ground-contacting element extending from a first retracted position to a second extended position; (c) causing the ground-contacting element to engage a surface when the traction element is in the second extended position; and/or (d) causing the ground-contacting element to retract to the first retracted position when the force applied to the extension inducing element is released or sufficiently relaxed.

Specific examples of the invention are described in more detail below. The reader should understand that these specific examples are set forth merely to illustrate examples of the invention, and they should not be construed as limiting the invention.

B. Some Specific Examples of Articles with Retractable Traction Elements

The various figures in this application illustrate examples of articles with retractable traction elements according to this invention. When the same reference number appears in more than one drawing, that reference number is used consistently in this specification and the drawings to refer to the same or similar parts throughout.

Figure 2:
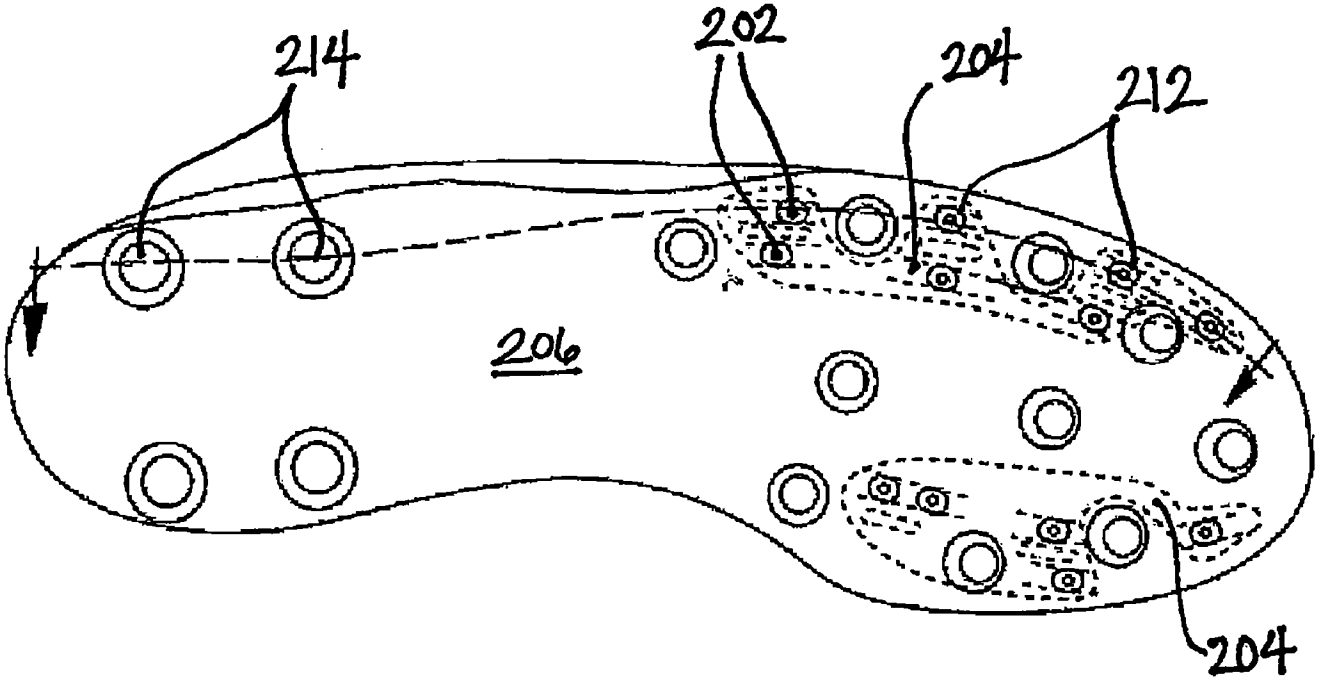
FIGS. 2, 2A, and 2B illustrate bottom and cross-sectional views of a plurality of retractable fraction elements embodied in an article of footwear, according to aspects of the invention.
Figures 2A, 2B:
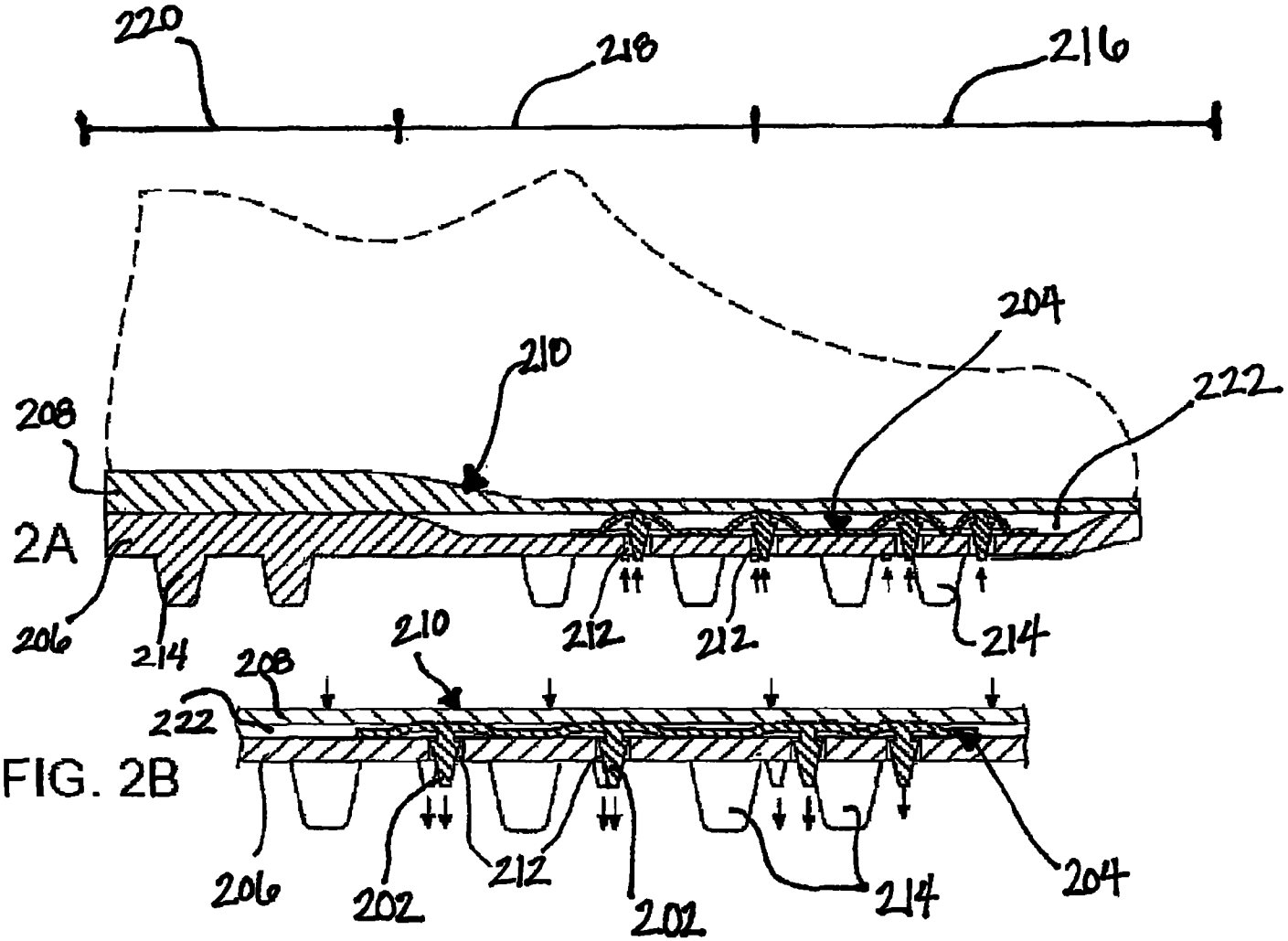

FIGS. 1A and 1B illustrate an article of footwear 100 having a plurality of retractable traction elements 102. The retractable traction elements 102 may be attached to or extend through the outsole 104 and may form a surface-contacting feature of the article of footwear 100. As shown in FIG. 2, the retractable traction elements 202 may be interconnected by a base member or insert 204. FIGS. 2A and 2B illustrate the insert 204 positioned between the outsole 206 and the midsole 208 of the sole member 210. The outsole 206 may define a plurality of holes 212 through which the retractable traction elements 202 may extend. In this example footwear structure, the retractable traction elements 202 may serve as secondary traction to the more permanent or non-retractable traction elements 214. The retractable traction elements 202 may be "activated" to extend through the holes 212 of the outsole 206 when sufficient force is applied to the midsole 208 and/or an insole (not shown), such as through the phases of a normal step cycle or when a user steps down or pushes off on the lateral or medial sides of the shoe. While the retractable traction elements 102 may be provided at any location or locations in the sole structure, in this illustrated example structure 100, the retractable traction elements are generally located along the medial and lateral edges in the forefoot region of the shoe 100.

Referring again to FIGS. 1A and 1B, the retractable traction elements 102 may be attached to some portion of the sole member 106 and/or any portion of the article of footwear 100. The retractable traction elements 102 may be attached in any suitable fashion including, but not limited to adhesives, molding, mechanical connecters, and the like. As shown in FIG. 2, the retractable traction elements 202 may be attached to the sole member 210 so that the insert 204 may be positioned between the midsole 208 and the outsole 206 and the retractable traction elements 202 may extend through the holes 212 in the outsole 206 to engage with the ground or other surface.

In this example footwear structure, a group of non-retractable traction elements 214 are attached to the outsole 206 and define a ground-contacting surface of the outsole 206. The non-retractable traction elements 214 remain static with respect to the sole structure 210 during the supination and pronation phases of the normal step cycle and may respond to varying angles and intensities of force. If desired, the non-retractable traction elements 214 may be detachable from the outsole 206 in any desired manner. The retractable or secondary fraction elements 202 may be selectively engaged (e.g., when the user steps down on the footwear at a specific angle, such as when stopping, changing directions, making a cut or turn, etc.) while the non-retractable traction elements 214 may serve as the non-retractable source of traction for the wearer.

FIGS. 2, 2A, and 2B illustrate a bottom view and cross-sectional views, respectively, taken along a longitudinal plane defined by line 2-2 of FIG. 1. The longitudinal axis extends along line 2-2 between the toe in the forefoot region 216 and the heel in the heel region 220 of the article of footwear. Both the retractable traction elements 202 and the non-retractable traction elements 214 may extend away from the sole member 210 and toward the ground. The retractable traction elements 202 may extend through holes 212 in the outsole 206 and may be spaced apart so that one or more of the retractable fraction elements 202 may be positioned in between one or more of the non-retractable traction elements 214.

A space 222 may be created between the outsole 206 and the midsole 208 in which the insert 204 may be positioned. The space 222 may extend along the portion of the sole member 210 that includes the insert 204. As illustrated in FIGS. 2, 2A, and 2B, the space 222 may extend at least partially through the forefoot region 216 and/or at least partially through the midfoot region 218. The heel region 220 may or may not have a space 222. In FIG. 2, the heel region 220 is illustrated without a space 222. Of course, the heel region 220 also may include one or more retractable traction elements without departing from the invention.

A first retractable traction element and a second retractable traction element within a single sole structure may be capable of moving independently from one another. The first retractable traction element may be in an extended position while the second retractable traction element may be simultaneously in a refracted position (or vice versa). This situation may occur when a wearer is pivoting on his or her foot or is changing direction and thus causing sufficient force to be applied to extend the retractable traction elements at some portions of the article of footwear, while insufficient force may be applied to other portions of the sole structure to cause other retractable traction elements to extend.

The first retractable traction element may contain a first set of characteristics and the second retractable traction element may contain a second set of characteristics that is different from the first set of characteristics. For example, the first retractable traction element may contain a first elasticity and flexibility and the second retractable traction element may contain a second elasticity and flexibility that is more rigid than the first elasticity and flexibility. The characteristics of the traction elements may include any features and/or materials. As another example, if desired, the retractable traction elements on the medial side of the article of footwear may differ in some manner(s) from the traction elements on the lateral side of the article of footwear.

Figure 3A:
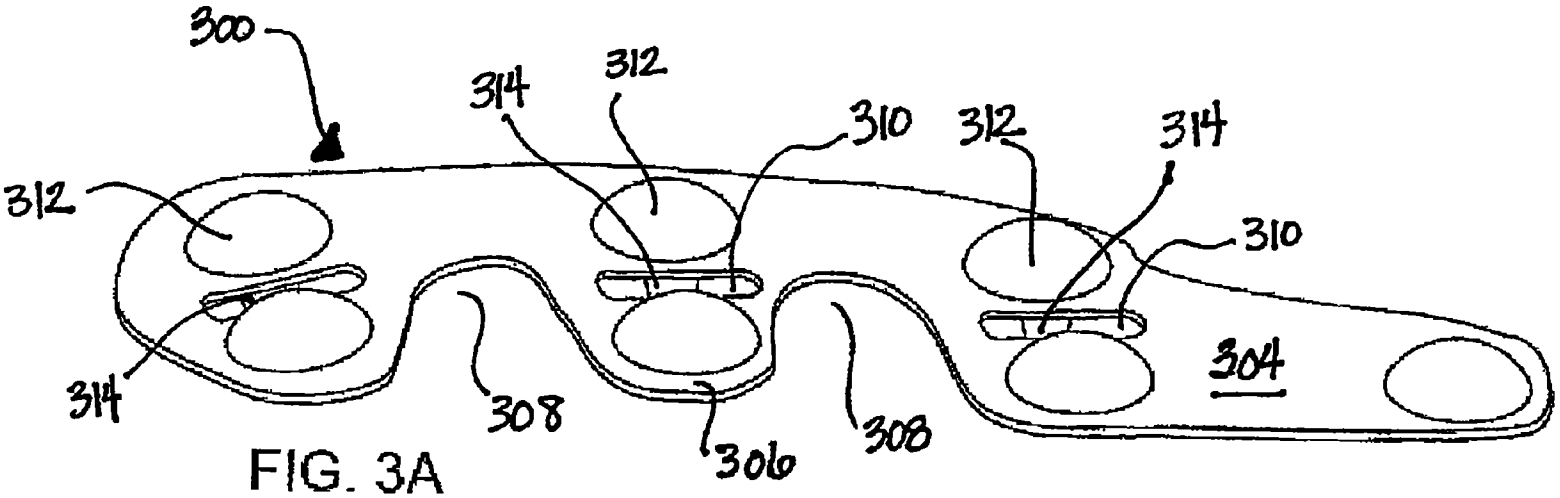
FIGS. 3A and 3B illustrate a top and bottom perspective view, respectively, of an insert having a plurality of retractable traction elements, in accordance with aspects of the invention.
Figure 3B:
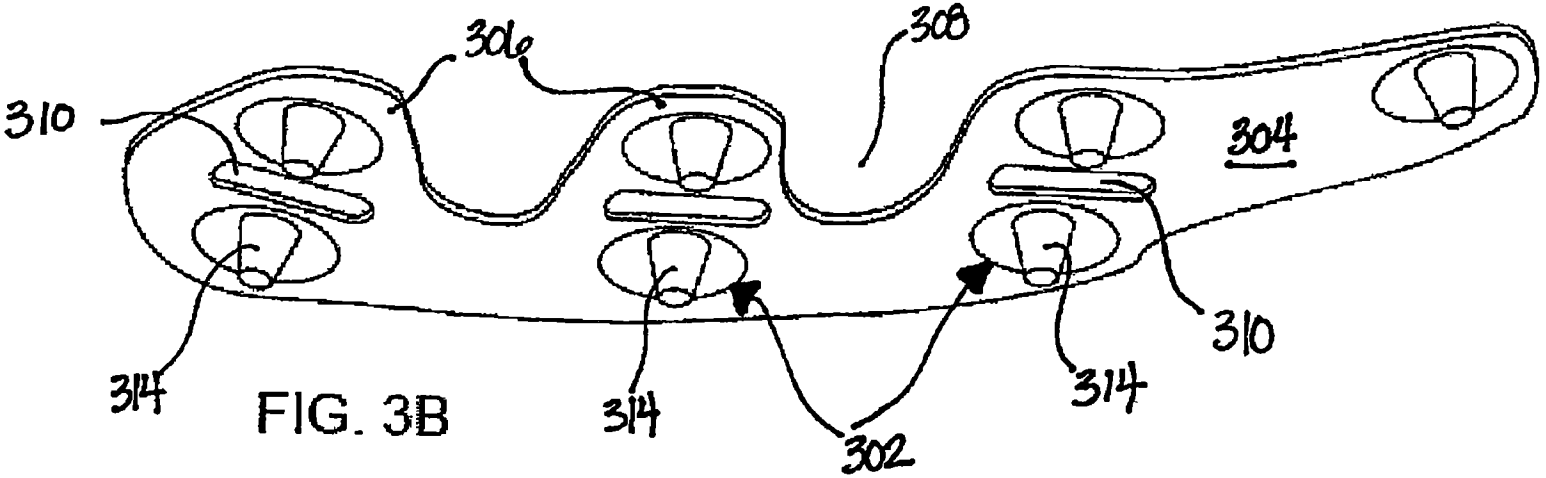

FIGS. 3A and 3B illustrate an example of an insert 300 or base having a plurality of retractable traction elements 302. The insert 300 may be shaped in any suitable shape. For example, the insert 300 may be generally oblong and may include a base member 304 having an elongated portion and a plurality of projections 306. The plurality of projections 306 may define one or more indentations 308 along the edge of the insert 300. The indentations 308 may be positioned around another element or elements in the sole structure, such as a non-retractable traction element, to which the insert 300 may be attached.

In at least some examples, the base member 304 of the insert 300 also may have a plurality of holes 310. The holes 310 may define a void that helps reduce the overall weight of the insert 300 and/or helps control the flexibility of the insert 300. For example, the insert 300 may be positioned between an outsole and a midsole of a member of an article of footwear. The insert 300 may be manufactured from a variety of suitable materials. The material may be one or more of a thermoplastic polyurethane elastomer (TPU), a nylon and TPU blend, PEBAX, rubber, plastics, or any other suitable material or combination of materials. The presence of the holes 310 or the voids results in an absence of material and an overall lighter weight of the insert 300 and may make the plate more flexible. The holes 310 may be positioned in any location on the insert 300. Any number of holes 310 may be included in the insert 300.

Figure 4A:
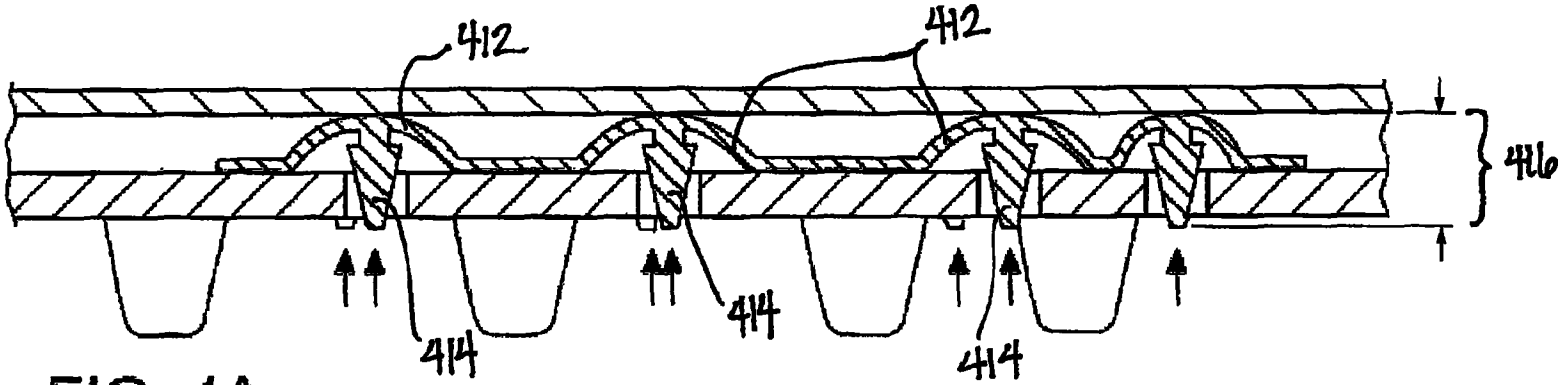
FIGS. 4A and 4B illustrate cross-sectional views of a portion of an outsole having a plurality of retractable traction elements, in accordance with another aspect of the invention.
Figure 4B:
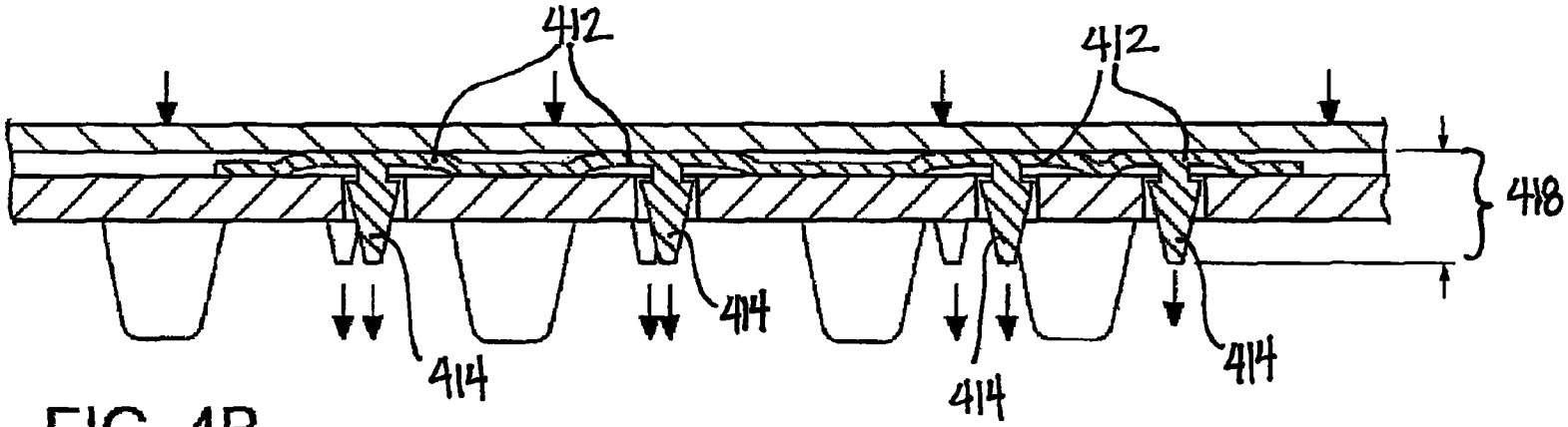

The insert 300 may include one or more traction elements 302, as illustrated in FIGS. 3A and 3B. One or more of the traction elements 302 may include an extension inducing element 312 and a ground-contacting element 314. In some examples, the ground-contacting element 314 may be fixedly attached to and/or in operational engagement with the extension inducing element 312. For example, FIGS. 4A and 4B illustrate how the extension inducing elements 412 may be shaped as a dome having an exterior, convex surface and an interior, concave surface. The ground-contacting element 414 may be fixedly attached to or integrally formed at the crest of the interior surface. The dome may flex in response to a force and may cause the ground-contacting element 414 to extend from a first (retracted) position 416 to a second (extended) position 418.

Figure 5:
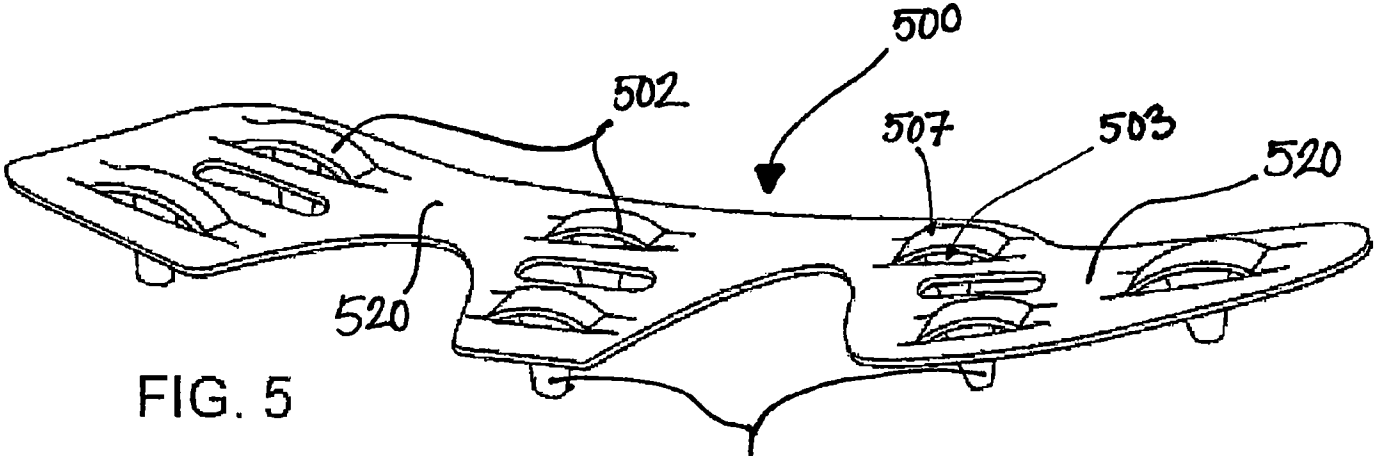
FIGS. 5, 5A, and 5B illustrate a top and cross sectional view of another embodiment of an insert having a plurality of retractable traction elements, according to aspects of the invention.

FIG. 5 illustrates another example insert 500 having a plurality of retractable traction elements that each includes an extension inducing element 502 and a ground-contacting element 504. In this example structure 500, the extension inducing elements 502 of the retractable traction elements are in the shape of a leaf spring. The extension inducing element 502 may have two opposing flat side walls 503 and a rounded top wall 507 defining an interior space 505. The two flat side walls 503 may define voids (i.e., the side walls are cut-out and do not have material) so that the top wall 507 or extension inducing element 502 may flex into the interior space 503 when adequate force is applied.

Figure 5A:
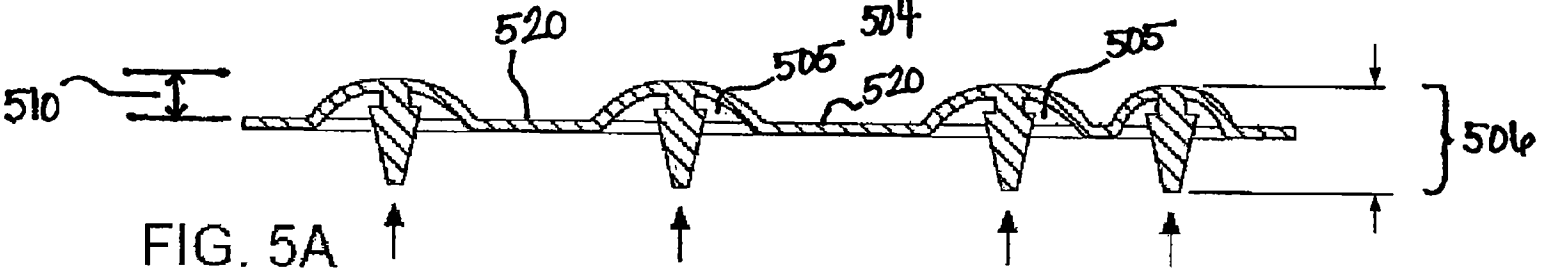
Figure 5B:
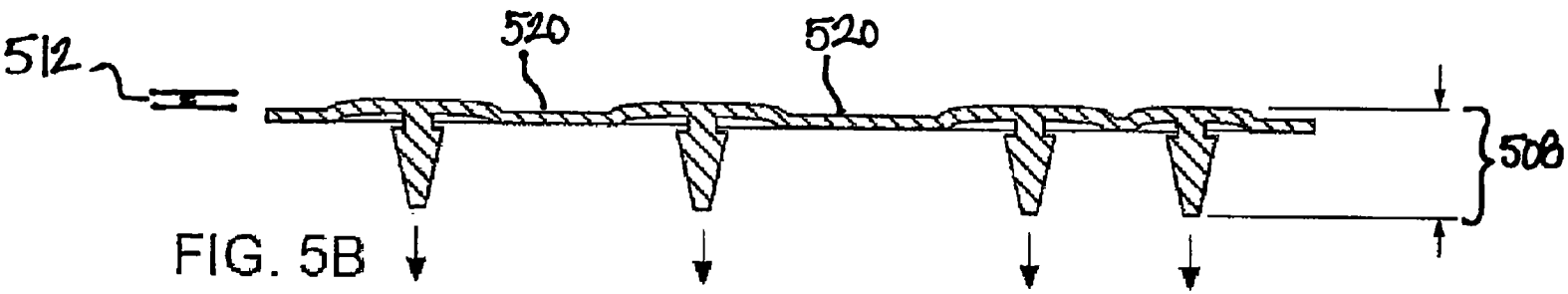

FIGS. 5A and 5B illustrate the leaf spring embodiment of the insert 500 in more detail. The ground-contacting elements 504 may extend from a first (retracted) position 506 to a second (extended) position 508. In some examples, as illustrated in FIGS. 5, 5A, and 5B, the extension inducing elements is curved upward above a base surface 520 of the insert 500. The upwardly curved top wall 507 may be flexed in response to sufficient force to extend from a first height 510 to a second height 512. In this case, the top wall 507 deforms and absorbs the force, which causes the ground-contacting elements to move to the extended position. The top wall 507 may flex in any suitable manner and may deform to any suitable size and shape.

The articles of footwear and the retractable traction elements illustrated in FIGS. 1A-5B may contain any number of inserts. The examples shown in FIG. 2 contain two inserts. The first insert may extend along a lateral portion within the forefoot and/or midfoot regions of the sole member. A second, independent insert may extend along a medial portion within the forefoot region of the sole member. If desired, another insert may be positioned within the heel region, midfoot region, and/or any region of the sole member of the article of footwear.

FIGS. 1A-5B illustrate examples of articles of footwear that may incorporate retractable traction elements. Many articles of footwear may benefit from the presence of retractable traction elements, such as athletic cleats, athletic footwear, water shoes, hiking boots, rock climbing shoes, work boots, protective footwear, military footwear, custom orthotic footwear, or the like. Any style or type of articles of footwear may incorporate retractable traction elements.

Figure 6:
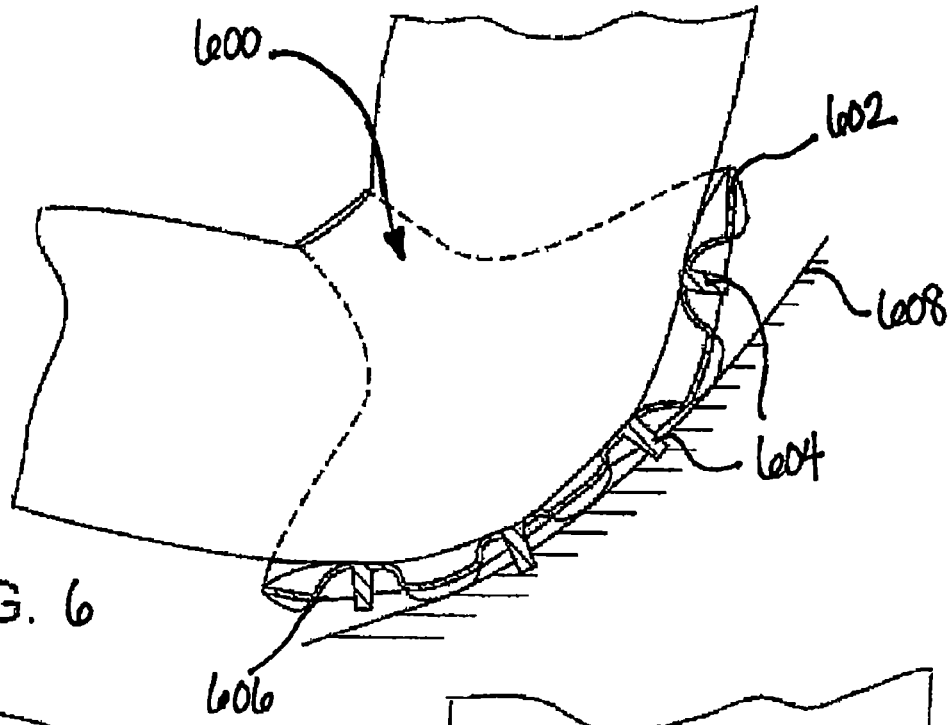
FIG. 6 illustrates an elbow pad containing a plurality of traction elements in an alternative embodiment according to aspects of the invention.

The retractable traction elements also may be used in articles of apparel, athletic equipment, and other protective gear, such as knee pads and elbow pads. FIG. 6 illustrates an elbow pad 600 including an insert 602 having a plurality of retractable traction elements 604. The retractable traction elements 604 may extend through an exterior surface 606 of the elbow pad 600 in response to sufficient force, such as when the elbow engages with the ground or other surface 608 during a fall.

Figure 7:
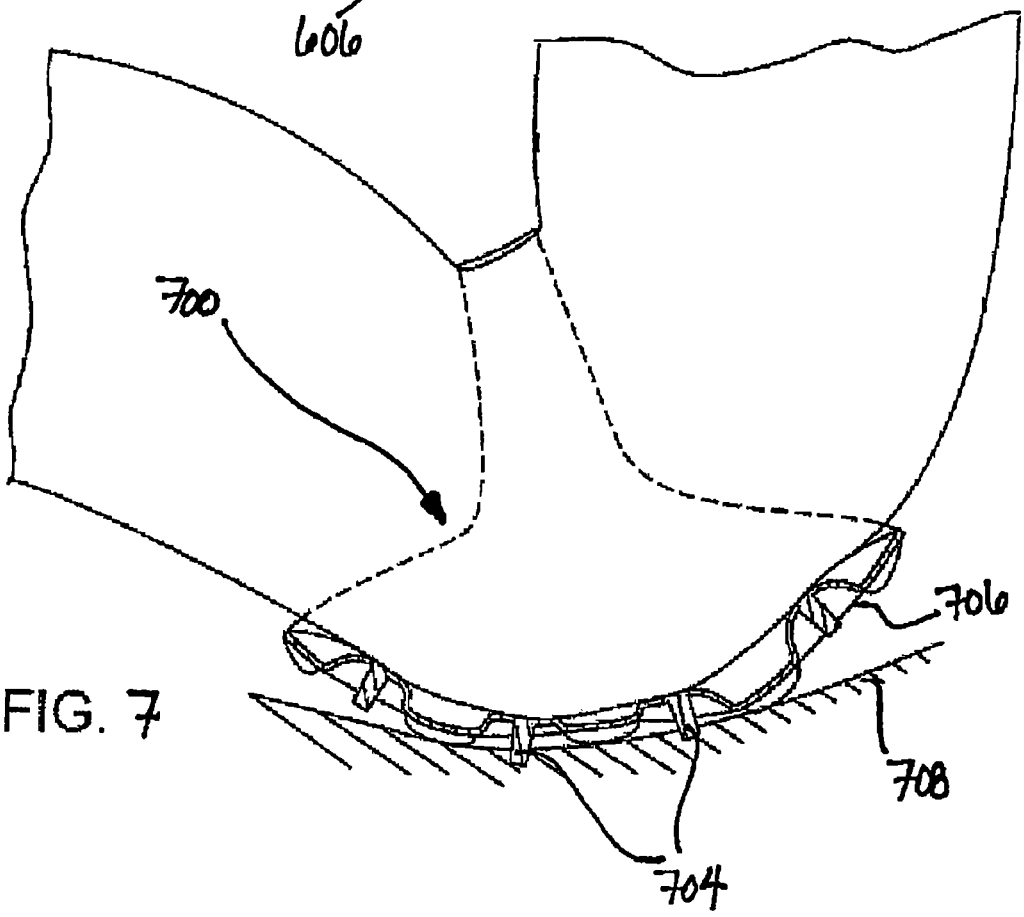
FIG. 7 illustrates a knee pad containing a plurality of traction elements in an alternative embodiment, in accordance with aspects of the invention.

FIG. 7 illustrates a knee pad 700 having an insert with a plurality of retractable traction elements 704 included therein in a similar fashion to the elbow pad 600 illustrated in FIG. 6. The retractable traction elements 704 may extend beyond an exterior surface 706 defined by the knee pad 700 when the user's knee engages with a surface 708, such as when the user falls or kneels on the ground, when the user climbs a hill or mountain, etc.

As illustrated in FIGS. 8 and 9, retractable traction elements may be provided in area rugs, door mats, or other similar surfaces. These retractable traction elements may engage with an underlying surface, such as the ground or carpeting, when sufficient force is applied. The retractable traction elements 902 in FIG. 9 illustrate a user's foot applying sufficient force to the top surface of the mat 900 to cause the traction elements at the area of the applied force to extend beyond the bottom surface of the mat 900, engage with the ground or other surface 906, and provide selectively available fraction and stability.

Mats having retractable traction elements of this type may be easier to remove from the underlying surface (such as the ground or carpet) as compared to similar mats with permanently extended and fixed traction elements.

A user may position a mat of the type illustrated in FIGS. 8 and 9 on any surface, such as a tile or smooth floor in a gymnasium, bathroom, or kitchen. The bottom surface of the mat may include a material that may be easily slid along the surface. The retractable traction elements may be made of a suitable material to provide a similar function in the bathroom and/or kitchen mat embodiment and in the gymnastics and/or acrobatic mat to selectively provide traction to the ground-contacting surface of the mat.

This same configuration may be applied to any surface that may be prone to slide against another surface. For example, cutting boards, oven mitts, hot pads, yoga and/or pilates mats, child changing pads, and any other article of manufacture that may engage with a surface. Many of these items may need to be moved or slid along a surface and would benefit from a selectively retractable traction feature, C. Additional Specific Examples of Articles with Retractable Traction Elements FIGS. 10-13, 14A, and 14B illustrate a traction element 1000 having a first plate 1002 that is positioned approximately parallel to a second plate 1004. A space 1006 is defined between the first plate 1002 and the second plate 1004. The traction element 1000 also includes an extendable portion 1008 that is integrally formed with the first plate 1002. The extendable portion 1008 alternatively may be attached to the first plate 1002 in any suitable fashion such as cement, glue, bonding, or the like. For example, the first plate 1002 may define a hole and the extendable portion 1008 may be attached to the first plate 1002 within the hole. The fraction element 1000 also may include a plunger 1010 that is integrally formed with the second plate 1004. The plunger 1010 may alternatively be attached to the second plate 1004 in any suitable fashion such as cement, glue, bonding, or the like. The plunger 1010 is positioned on the second plate 1004 so that the plunger 1010 is aligned with the extendable portion 1008. When a force is applied to the second plate 1004, the plunger 1010 causes the extendable portion 1008 to extend from a first, retracted position to a second, extended position.

As noted above, FIG. 10 illustrates a traction element 1000 having a two plate configuration in which a space 1006 is defined between the first plate 1002 and the second plate 1004. A midsole may be placed in this space 1006, which will be described in greater detail below. The extendable portion 1008 is integrally formed with the first plate 1002 at a location that is approximately centered within the first plate 1002. The plunger 1010 is integrally formed with the second plate 1004. A tip 1012 is positioned over a portion of the extendable portion 1008 to form a portion of the ground-contact surface of the extendable portion 1008. The tip 1012 is a separate component in this embodiment and may include a high density polyethlylene (HDPE) material or any other suitable material. Oftentimes, the tip 1012 is a rather hard material since it forms the ground-contact surface of the extendable portion 1008 of the traction element 1000.

Figure 10:
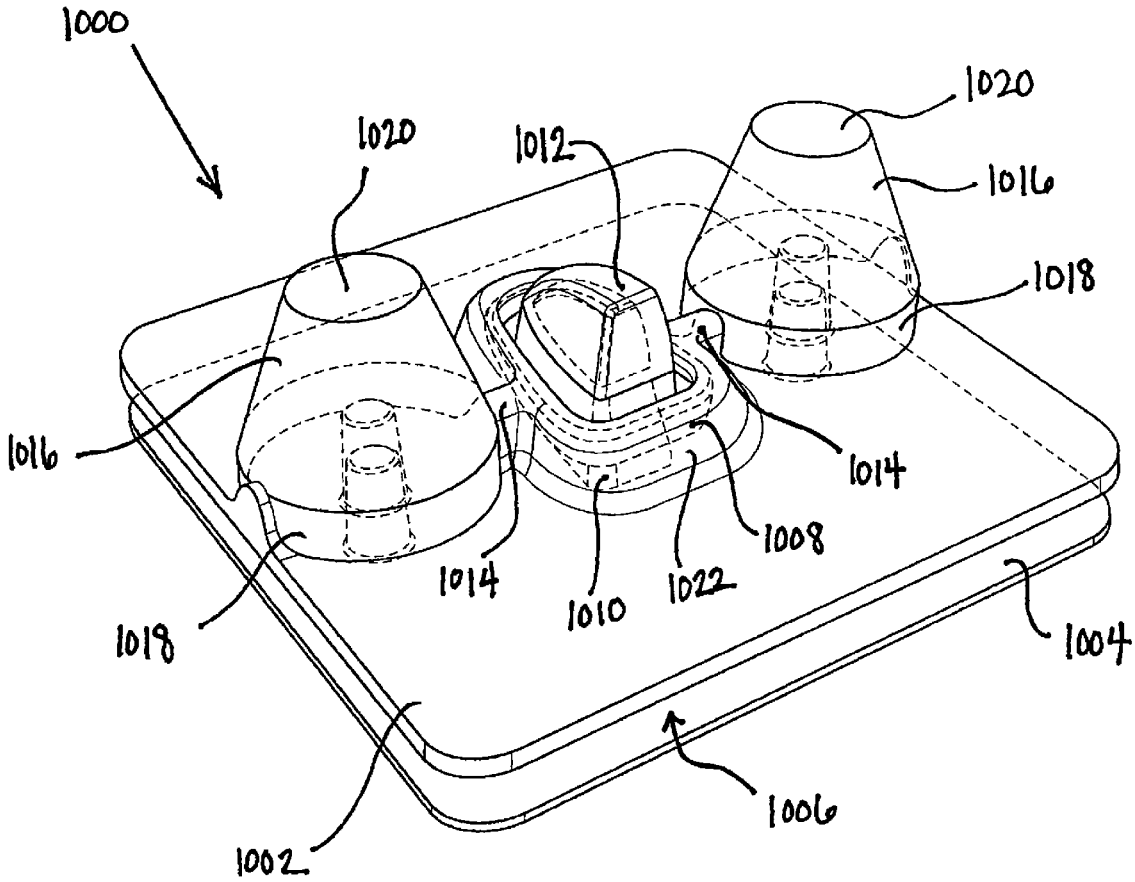
FIG. 10 illustrates a perspective view of another embodiment of a traction element according to aspects of the invention.

FIG. 10 also illustrates a stabilizing member 1014 that is integrally formed with the first plate 1002. In an alternative embodiment, the stabilizing member 1014 may be attached to the first plate 1002 in any suitable manner, such as bonding, gluing, cementing, and the like. In the example shown in FIG. 10, the stabilizing member 1014 extends laterally straight across the entire surface of the first plate 1002. However, the stabilizing member 1014 may extend across any portion of the first plate 1002 and may extend in any direction. The stabilizing member 1014 may extend in a straight or curved line.

Additionally, FIG. 10 illustrates two primary traction elements 1016 that are attached to or integrally formed with the first plate 1002 and are positioned on opposite sides of the extendable portion 1008. Each of the primary traction elements 1016 are spaced apart from the extendable portion 1008. In this example, both of the primary traction elements 1016 are spaced apart from the extendable portion 1008 the same distance. The primary traction elements 1016 may be spaced apart from the extendable portion 1008 in any suitable fashion and at any suitable distance. The primary fraction elements 1016 are positioned to extend over a portion of the stabilizing element in this example; however, the primary traction elements 1016 may be attached to the first plate 1002 in any suitable location on the first plate 1002. The primary traction elements 1016 will contact the ground before the extendable portion 1008 of the traction element 1000. The primary fraction elements 1016 may be any suitable shape and size. For example, the primary traction elements 1016 illustrated in FIG. 10 are tapered from a first end 1018 that is attached to the first plate 1002 toward a second, opposing end 1020. The primary traction elements 1016 may include any materials and often include a relatively hard material.

A housing 1022 may surround at least a portion of the extendable portion 1008. In FIG. 10, the housing 1022 surrounds the entire extendable portion 1008 and is also integrally formed with the first plate 1002. Alternatively, the housing 1022 may be attached to the first plate 1002 in any suitable manner, such as cementing, bonding, and gluing. The housing 1022 also may be integrally formed with the stabilizing member 1014, as illustrated in FIG. 10. The housing 1022 also may house any portion of the extendable portion 1008.

The first plate 1002 and the second plate 1004 may include any suitable materials including, but not limited to: carbon reinforced fiber, HDPE, PEBAX, polyurethane nylon, thermosetting polyurethane, and thermoplastic polyurethane (TPU). The extendable portion 1008 may include any suitable materials including, but not limited to, a soft TPU material, such as a TPU having a hardness rating of 80 A or below as measured on a Shore-A hardness scale. The plunger 1010 may include any suitable materials including, but not limited to, carbon reinforced fiber, HDPE, PEBAX, polyurethane nylon, thermosetting polyurethane, and TPU materials.

Figure 11:
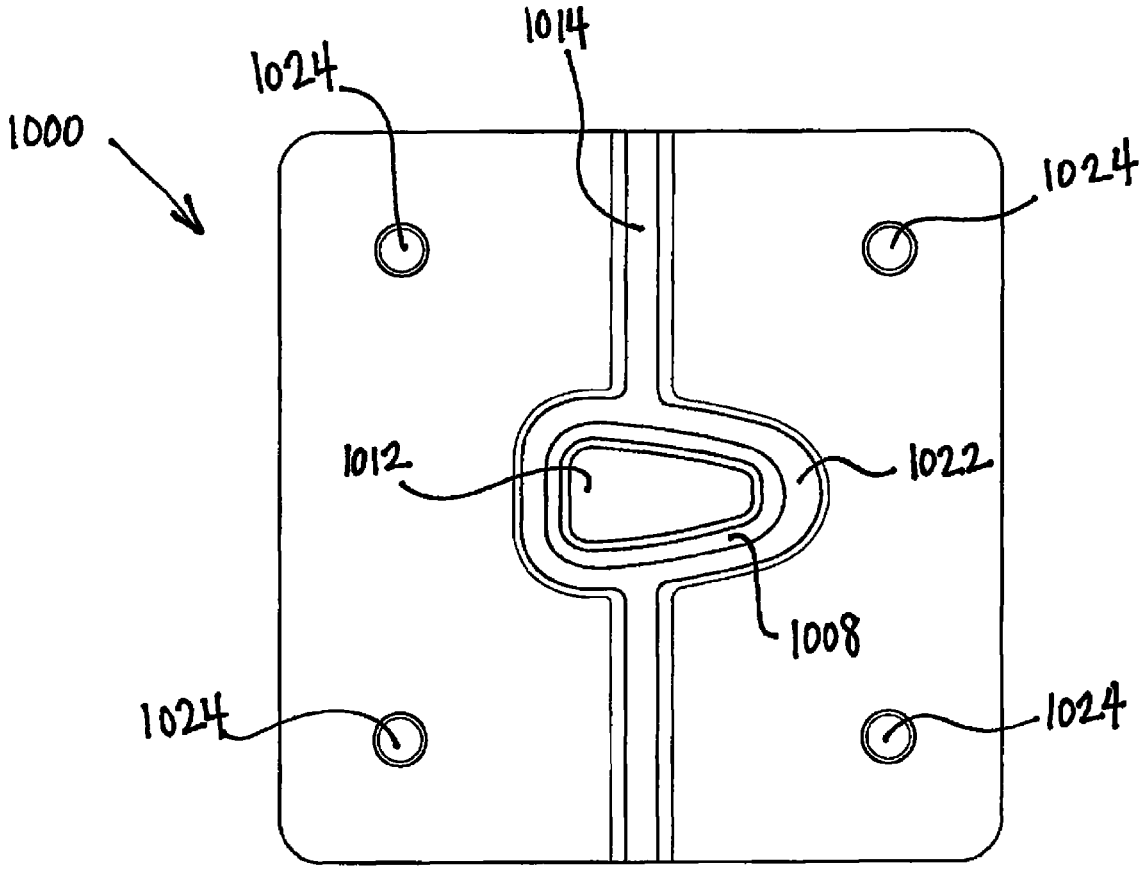
FIG. 11 illustrates a top plan view of the traction element illustrated in FIG. 10.

FIG. 11 illustrates a top plan view of another configuration of the traction element 1000 illustrated in FIG. 10. The housing 1022 is positioned approximately in the center of the first plate 1002. The extendable portion 1008 is shown within the housing 1022 and the tip 1012 is attached to the extendable portion 1008. The stabilizing member 1014 is illustrated as extending away from the housing 1022 in a manner than extends laterally across the first plate 1002. In the example shown in FIG. 11, the traction element 1000 is illustrated with a retaining mechanism 1024, but without the primary traction elements. One or more primary traction elements may be attached to the first plate 1002 and positioned to cover one or more of the holes of the retaining mechanism 1024.

Figure 12:
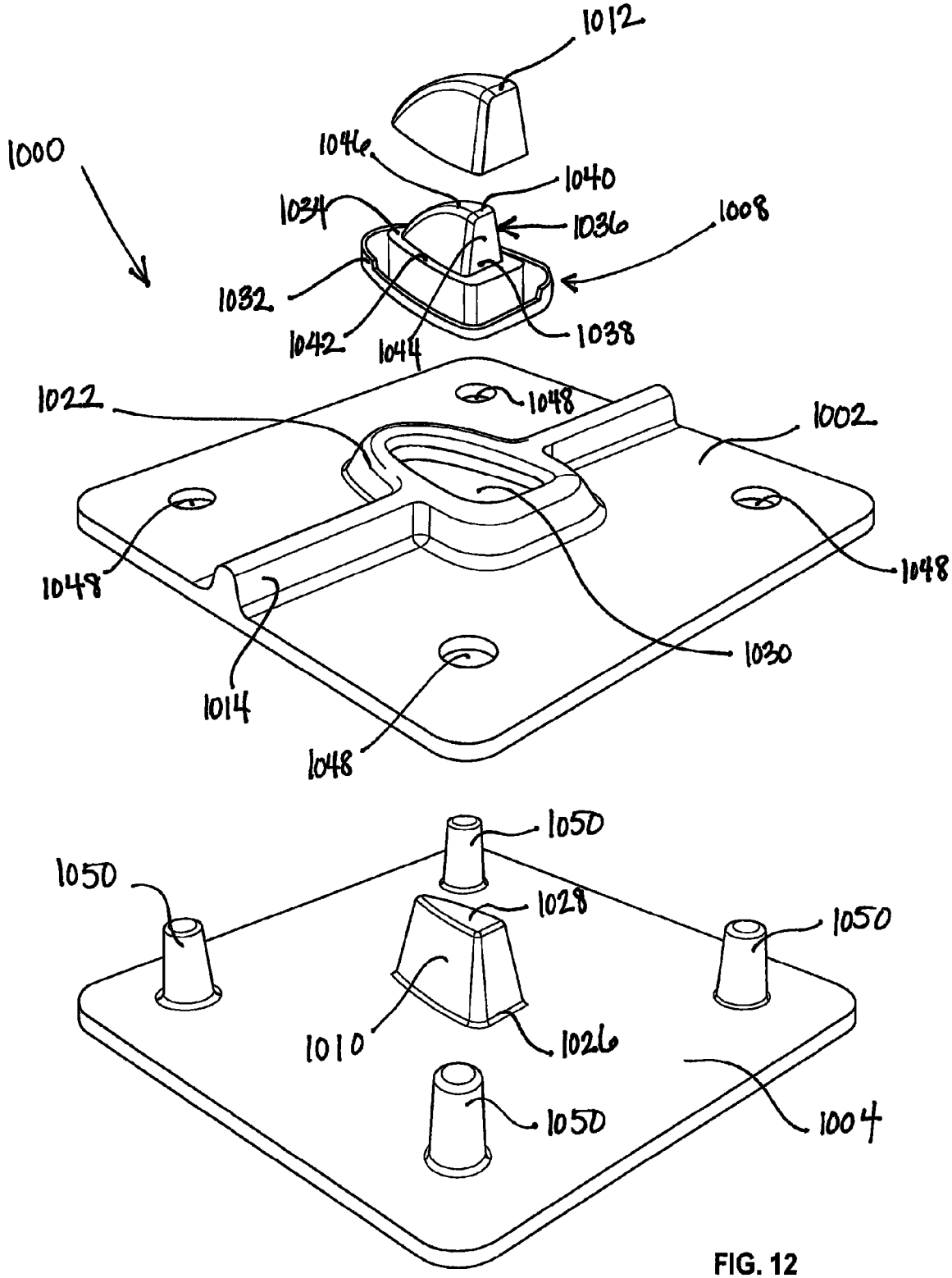
FIG. 12 illustrates an exploded view of the traction element illustrated in FIG. 10.

FIG. 12 illustrates an exploded view of the traction element 1000 in a configuration with a first plate 1002 and a second plate 1004 that are positioned approximately parallel to each other. The first plate 1002 and the second plate 1004 are approximately the same size and shape, although each may be any desired shape and size. In some examples, the first plate 1002 and the second plate 1004 are different sizes and/or shapes. In the example construction illustrated in FIG. 12, the first plate 1002 and the second plate 1004 are approximately square-shaped with rounded corners. The second plate 1004 includes a plunger 1010 that is integrally formed therewith. The plunger 1010 alternatively may be attached to the second plate 1004 as a separate component.

The plunger 1010 is positioned in approximately the center of the second plate 1004 at a location that aligns the plunger 1010 with the extendable portion 1008 on the first plate 1002. The plunger 1010 has a first end 1026 that is proximate to the second plate 1004 and a second, opposing end 1028. The plunger 1010 may be any suitable shape such as a cone shape. In the example illustrated in FIG. 12, the plunger 1010 is a three-sided shape that is tapered as it extends from the first end 1026 to the second end 1028. The edges of the plunger 1010 are curved in this example, but they also may be beveled or any angled edges.

FIG. 12 also illustrates the first plate 1002 having a housing 1022 and stabilizing member 1014 integrally formed therewith. In alternative examples, the housing 1022 and stabilizing member 1014 are attached to the first plate 1002. The housing 1022 and the first plate 1002 define a hole 1030 that is shaped in a triangle with rounded corners in a similar fashion to the plunger 1010. The hole 1030 is shaped and sized so that at least a portion of the extendable portion 1008 is capable of fitting within the hole 1030.

The traction element 1000 illustrated in FIG. 12 also includes an extendable portion 1008. The extendable portion 1008 includes a bellows structure 1032, a base 1034, and a protrusion 1036. The bellows structure 1032 and the base 1034 are shaped in a similar and complementary shape to the triangular shape of the plunger 1010. The bellows structure 1032 of the extendable portion 1008 fits within the housing 1022 so that the housing 1022 at least partially houses the bellows structure 1032. In this example, the base 1034 and the protrusion 1036 fit within the hole defined in the housing 1022 and the first plate 1002 so that at least a portion of the base 1034 and the protrusion 1036 extend beyond the surface of the first plate 1002 and the housing 1022. The protrusion 1036 has a first end 1038 proximate to the base 1034 and a second end 1040 opposite the first end 1038. The first end 1038 of the protrusion 1036 is sized to be smaller than the base 1034 to which it is proximate so that the place at which the protrusion 1036 and the base 1034 meet forms a shoulder 1042. A tip 1012 is positioned to cover the protrusion 1036 and rest upon the shoulder 1042 between the base 1034 and the protrusion 1036. The tip 1012 is hollow and shaped in a complementary fashion to the protrusion 1036. The protrusion 1036 fits within the hollowed inside portion of the tip 1012. The tip 1012 forms the ground-contact surface of the extendable portion 1008 and includes a relatively hard material, such as HDPE or PEBAX. In an alternative embodiment, a portion of the protrusion 1036 is treated or otherwise hardened and forms the ground-contact surface of the extendable portion 1008 (i.e., the extendable portion 1008 does not include a separate "tip" but defines the tip by treating or otherwise hardening a ground-contact surface portion of the extendable portion 1008).

In FIG. 12, the protrusion 1036 of the extendable portion 1008 is shaped as a fin-like structure and includes a flat surface 1044 and a curved surface 1046. The flat surface 1044 extends from the base 1034 at approximately 90° and the curved surface 1046 extends away from the flat surface 1044 down to the base 1034. In FIG. 12, the tip 1012 is hollow and is also shaped as a fin-like structure so that it fits over the protrusion 1036 of the extendable portion 1008. The flat surface of the tip 1012 may engage the ground and provide fraction as the user applies force to the ground.

The base 1034 and the protrusion 1036 may be hollowed out so that that plunger 1010 on the second plate 1004 may be positioned to fit within a portion of the hollowed out space. This configuration also would provide a retaining mechanism 1024 for retaining the free end of the plunger 1010 to be in contact with or located within the extendable portion 1008. The plunger 1010 and the extendable portion 1008 may contact each other in any suitable fashion in various example configurations.

The traction element 1000 illustrated in FIG. 12 also includes a retaining mechanism that maintains a position of the first plate 1002 with respect to the second plate 1004. In this example, the retaining mechanism includes four holes 1048 in the first plate 1002 and four corresponding posts 1050 on the second plate 1004. The posts 1050 may be attached to or integrally formed with the second plate 1004. The holes 1048 are positioned in approximately each of the four corners of the square-shaped first plate 1002 and the posts 1050 are positioned in approximately each of the four corners of the square-shaped second plate 1004. The posts 1050 and the corresponding holes 1048 are aligned with one another when the first plate 1002 and the second plate 1004 are aligned with each other. The posts 1050 extend through the corresponding holes 1048 when the extendable portion 1008 is in its refracted position and when it is in its extended position, which will be discussed in greater detail below. Optionally, if desired, static or primary traction elements may be provided over the holes 1048, to prevent moisture, dirt, or debris from entering the shoes (and the posts 1050 may each extend within interior spaces provided in the static or primary traction elements).

Figure 13:
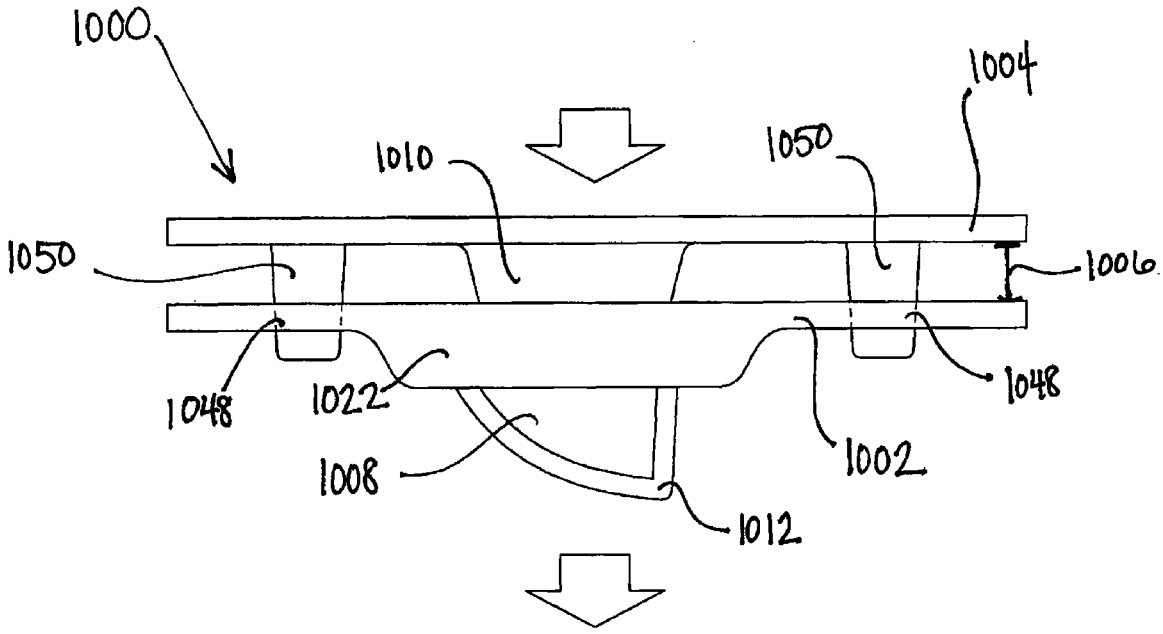
FIG. 13 illustrates a side view of the traction element illustrated in FIG. 10.
Figure 14A:
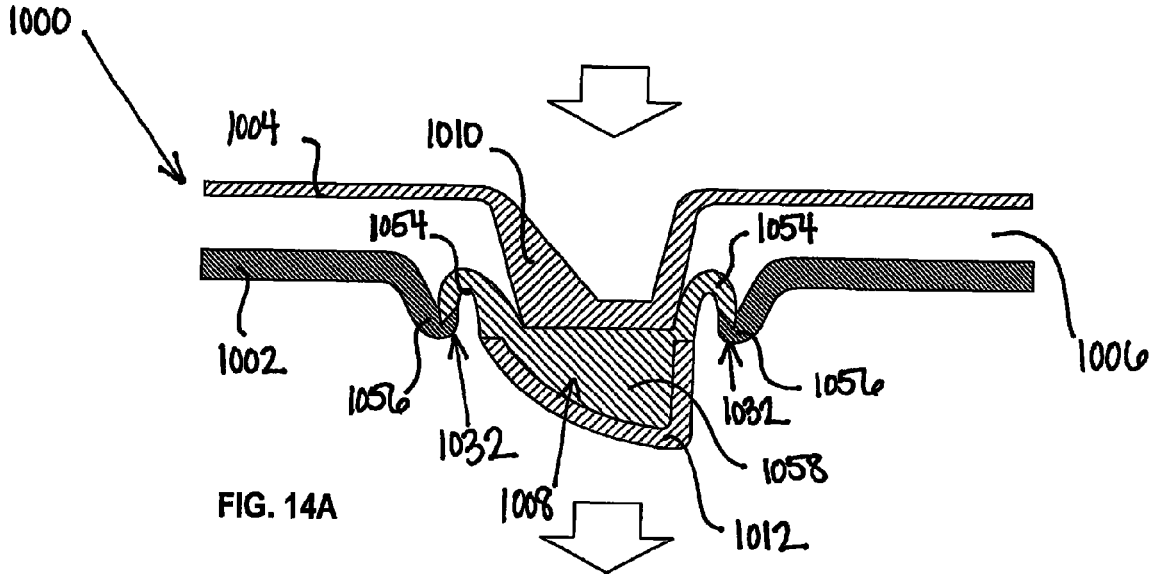
FIGS. 14A & 14B illustrate a cross-sectional view of the traction element illustrated in FIG. 10 in a retracted and in an extended position, respectively.
Figure 14B:
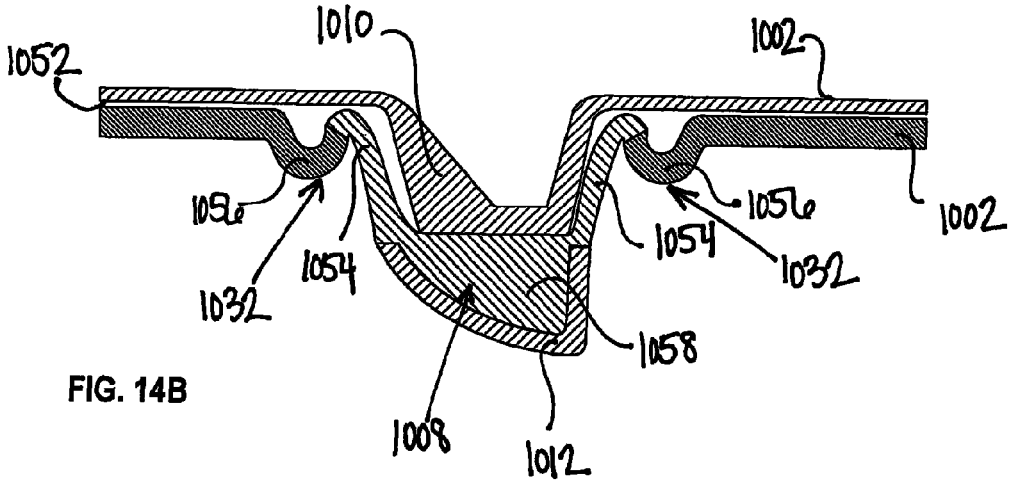

As illustrated in FIGS. 13, 14A, and 14B, the first plate 1002 and the second plate 1004 of the traction element 1000 are positioned approximately parallel to one another and are spaced apart from one another. A space 1006 is defined between the two plates. The first plate 1002 and the second plate 1004 are spaced apart a first distance when the extendable portion 1008 is in a first, retracted position, as illustrated in FIGS. 13 and 14A. The first plate 1002 and the second plate 1004 are spaced apart a second distance 1052 when the extendable portion 1008 is in a second, extended position as illustrated in FIG. 14B. The first distance is greater than the second distance 1052. When the extendable portion 1008 is flexed by a force, the distance between the first plate 1002 and the second plate 1004 is decreased. The force may be any force. In examples where these traction elements are incorporated into sole structures of footwear, the force is a force from a wearer's foot that is applied during use of the footwear.

FIG. 13 illustrates a side view of the traction element 1000 that is illustrated in FIG. 12. The arrows represent a force that would be received by the traction element 1000. The traction element 1000 in FIG. 13 also illustrates two posts 1050 on the second plate 1004 that are extending through two corresponding holes 1048 in the first plate 1002 to retain the first plate 1002 and the second plate 1004 in a position spaced apart from each other. If desired, the posts 1050 and holes 1048 may be replaced by a spring type mechanism that biases the two plates 1002 and 1004 apart when no external force (or an insufficient amount of external force) is applied to the plate 1004.

FIGS. 14A and 14B illustrate the traction element 1000 in the retracted position and the extended position, respectively. The extendable portion 1008 extends in a direction that is approximately 90° away from the surface of the first plate 1002. When a force is applied to the second plate 1004, the plunger 1010 applies a force to the extendable portion 1008 and causes the extendable portion 1008 to extend in the direction of the arrows in FIGS. 14A and 14B (i.e., approximately 90° away from a base surface of the first plate 1002). The extendable portion 1008 may be configured to extend any desired distance. In this example, the extendable portion 1008 extends up to 4 mm. The distance that the extendable portion 1008 extends corresponds to the distance between the first plate 1002 and the second plate 1004. The distance between the first plate 1002 and the second plate 1004 may serve as a stopping mechanism for the extendable portion 1008 so that it does not extend beyond the specified distance.

The traction element 1000 illustrated in FIGS. 14A and 14B also includes a bellows structure 1032. The bellows structure 1032 is s-shaped and includes at least a portion of the extendable portion 1008 in this illustrated example. The bellows structure 1032 is capable of flexing in response to a force applied from the plunger 1010. The s-shape of the bellows structure 1032 serves as a kind of spring that receives the force from the plunger 1010 and uncurls into a straighter form, as shown in FIG. 14B. In some examples, the bellows structure 1032 comprises two portions, a first portion 1054 and a second portion 1056. The first portion 1054 may include a portion of the extendable portion 1008, as just described. The second portion 1056 may include a portion of the first plate 1002. In this example, the portion of the first plate 1002 that forms the second portion 1056 of the bellows structure 1032 may be flexible, but is not required to be flexible. In the examples where the portion of the first plate 1002 in the second portion 1056 of the bellows structure 1032 is flexible, that portion of the first plate 1002 also may be s-shaped or u-shaped and also may flex and "uncurl" when a force is applied to the extendable portion 1008 by the plunger 1010.

The bellows structure 1032 is designed to be any suitable extendable structure. For example, the bellows structure 1032 may include any number of "s-shapes," "u-shapes," "v-shape," curves, or any other suitable extendable configuration. The bellows structure 1032 may be configured in any desired fashion. For example, the bellows structure 1032 may be positioned horizontally with respect to the extendable portion 1008, as shown in FIGS. 14A and 14B. The bellows structure 1032 also may be positioned vertically or in any other direction with respect to the extendable portion 1008. The bellows structure 1032 may be made up entirely of the extendable portion 1008. A body 1058 of the extendable portion 1008 may or may not be made of extendable or flexible material. The portion of the extendable portion 1008 that comprises at least a portion of the bellows structure 1032 is flexible and may be made of any suitable flexible material, such as a soft TPU with a hardness rating of 70 A-75 A on the Shore-A hardness scale.

The first plate 1002 and the second plate 1004 define a space 1006 therebetween. Within that space may be positioned a midsole. The midsole may comprise any suitable material, such as compressible foam. In other examples, the midsole may include one or more fluid-filled bladders. The midsole moderates the force applied to the first plate 1002 and may bias the plates of the traction elements apart after the force has been removed or sufficiently relaxed. Alternatively, if desired, a spring mechanism or other biasing construction may be used to force the plates apart (back to their retracted positions) once the force is removed or sufficiently relaxed.

In some examples, the first and the second plate include a second plunger and a second extendable portion. The second set of the plunger and extendable portion may be very similar is construction to the first set of the plunger and extendable portion. For example, the second set may include a second bellows structure that is formed at least partially from the second extendable portion. The second set of plunger and extendable portion may operate discretely from the first set that is described above in FIGS. 10-13, 14A, and 14B. Each set may receive at least a portion of the force that is applied to the first plate. In some cases, only one of the sets receives a portion of the force. In other examples, both sets receive all of the force. Any number of sets of plungers and extendable portions may be included on a set of plates.

The traction elements also may include a pad that extends over at least a portion of the first plate. In this example, the force may be applied to the pad rather than the first plate directly.

Any example traction element described above may be incorporated into footwear. A sole structure may comprise a sole base member and one or more of any example embodiment of the traction elements described above. In some examples, the sole structure includes two or more of the traction elements describe above. Such sole structures may be included in an article of footwear. The article of footwear may include an upper and a sole structure attached thereto. At least one of any of the embodiments of the traction elements described above may be attached to the sole structure of this article of footwear. The sole structures and the footwear may include a pad that extends over at least a portion of the first plate of the traction elements, as described above. This pad may be a sockliner or other type of insole that is inserted into the space defined by the upper and the sole structure. The traction elements may be incorporated into any article of wear or article of manufacture.

The traction elements may be positioned in any suitable location on the sole structure. For example, one or more of any embodiment of the traction elements described above may be positioned within the forefoot region of the sole structure. One or more may be positioned so that it would extend beneath the big toe and/or the metatarsophalangeal joint of the wearer's foot when the wearer's foot is positioned within the footwear. The traction elements also may be positioned along the medial and/or lateral edge of the forefoot region of the sole structure. Further, the traction elements may be positioned in the heel region of the footwear (e.g., to provide extra traction while backpedaling, etc.).

In the footwear examples, the space that is created between the first plate and the second plate, along with the force required to extend the extensible elements, provides an impact/force attenuating property to the traction elements described above. The force applied by the wearer's foot to the second plate is slowly absorbed by the motion of the first plate with respect to the lower plate, thus decreasing the intensity of the force. The shape and size of the second plate helps to moderate and "spread out" the pressure that the plunger may apply to the wearer's foot. A large second plate also helps to moderate and spread out the pressure that the plunger and other elements of the traction element may apply to the wearer's foot. Further, in the examples in which the plunger and/or any other portions of the traction element are integrally formed with the plates will also help to moderate the pressure that the wearer feels on his or her foot.

D. Additional Specific Examples of Articles with Retractable Traction Elements

FIGS. 15-18, 19A, and 19B illustrate a traction element 1500 comprising a first plate 1502, a second plate 1504 positioned approximately parallel to the first plate 1502, an extendable portion 1506, and a protrusion 1508. A space 1510 is defined between the first plate 1502 and the second plate 1504. The second plate 1504 has a first surface 1512 and a second, opposing surface 1514. The first plate 1502 has a plunger 1516 protruding therefrom. The extendable portion 1506 is attached to or integrally formed with the second plate 1504. The protrusion 1508 extends away from the first surface 1512 of the second plate 1504. The protrusion 1508 and the extendable portion 1506 are spaced apart from one another. In response to a force applied to the first plate 1502, the plunger 1516 applies a force to the second surface 1514 of the second plate 1504 to cause the extendable portion 1506 to flex which causes the protrusion 1508 to extend from a first, retracted position to a second, extended position.

As noted above, FIG. 15 illustrates a traction element 1500 having a two plate configuration in which a space 1510 is defined between the first plate 1502 and the second plate 1504. A midsole may be placed in this space 1510, as will be described in greater detail below. The extendable portion 1506 is formed integrally with the first plate 1502 at a location that is approximately centered within the first plate 1502. The plunger 1516 is integrally formed with the first plate 1502, but is not seen in this figure.

Figure 15:
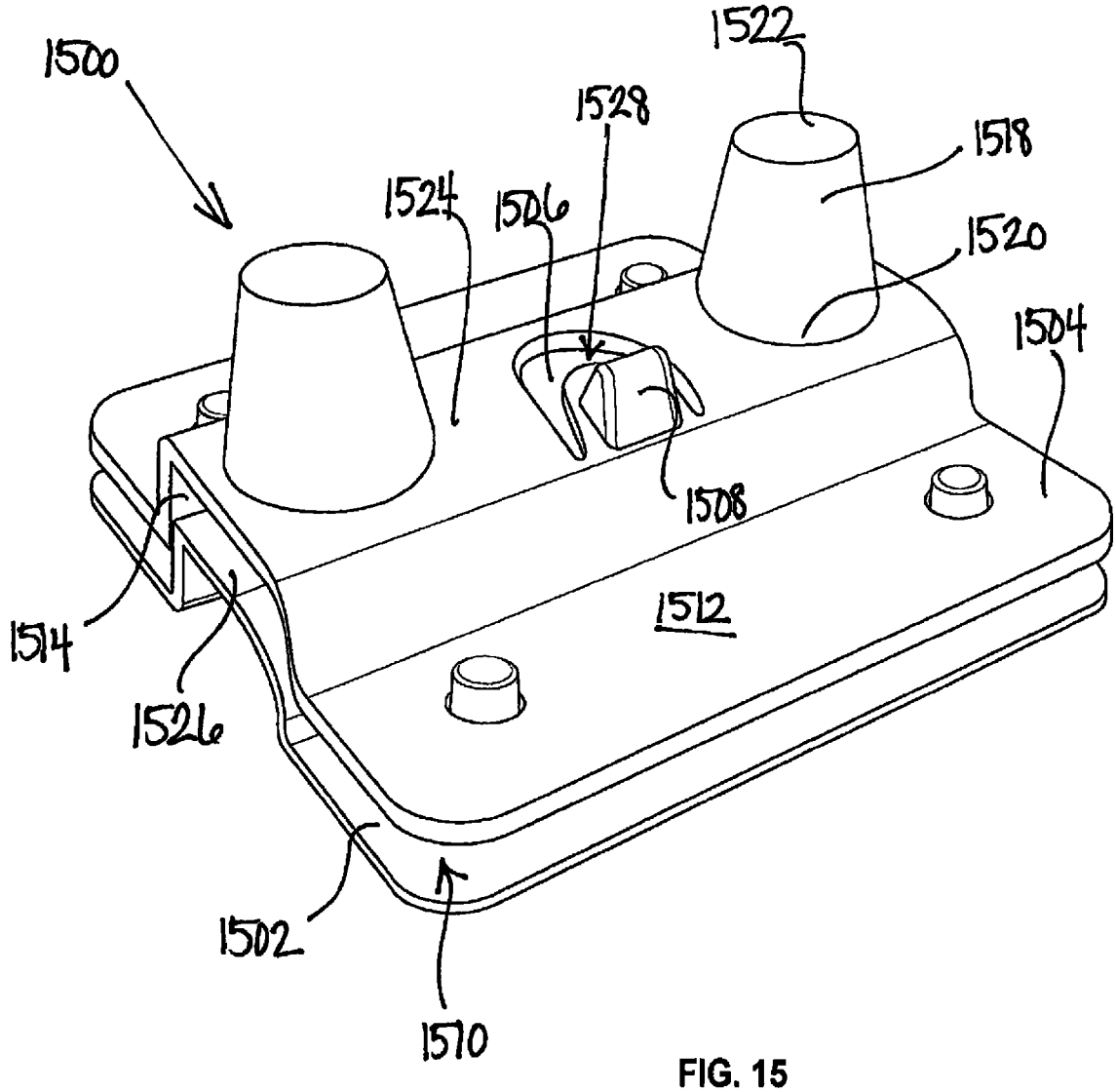
FIG. 15 illustrates a perspective view of yet another embodiment of a traction element in accordance with aspects of this invention.

Additionally, FIG. 15 illustrates two primary traction elements 1518 that are positioned on opposite sides of the extendable portion 1506. Each of the primary traction elements 1518 are spaced apart from the extendable portion 1506. In this example, both of the primary traction elements 1518 are spaced apart from the extendable portion 1506 the same distance. The primary traction elements 1518 may be spaced apart from the extendable portion 1506 in any suitable fashion. The primary traction elements 1518 will contact the ground before the extendable portion 1506 of the traction element 1500. The primary traction elements 1518 may be any suitable shape and size. For example, the primary traction elements 1518 illustrated in FIG. 15 are tapered from a first end 1520 that is attached to the second plate 1504 toward the second, opposing end 1522. The primary traction elements 1518 may include any materials and often include a relatively hard material.

A housing 1524 may surround at least a portion of the extendable portion 1506. In FIG. 15, the housing 1524 extends laterally across second plate 1504. The housing 1524 is integrally formed with the second plate 1504. Alternatively, the housing 1524 may be attached to the second plate 1504 in any suitable manner, such as cementing, bonding, and gluing. The second plate 1504 may have a center portion 1526 that mirrors the shape of the housing 1524 on the second plate 1504 such that the center portion 1526 is capable of being positioned to fit within the shape of the housing 1524. Because of the complementary configuration of the first plate 1502 and the second plate 1504, the plates may move toward and away from one another while remaining in parallel to each other. In this way, each portion of the first plate 1502 remains in parallel with each portion of the second plate 1504. Moreover, this shape helps moderate the feel of the extendable traction element as the plunger 1516 may be located away from (and therefore not placing direct pressure on) the wearer's foot. However, the first plate 1502 may be any suitable shape. The first plate 1502 may be flat throughout the center portion 1526 in an alternative example.

Figure 16:
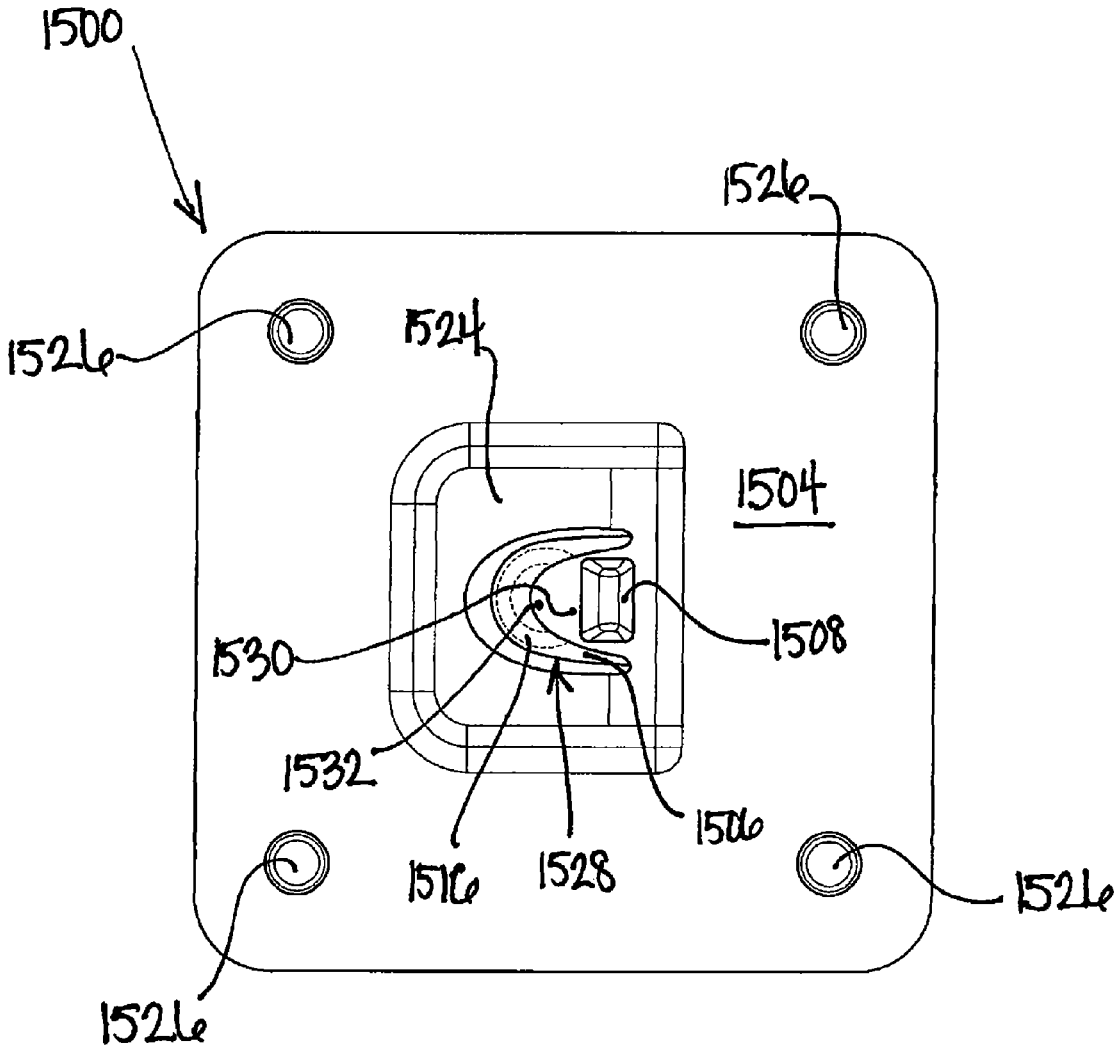
FIG. 16 illustrates a top plan view of the traction element illustrated in FIG. 15.

The housing 1524 may house at least a portion of the extendable portion 1506. FIG. 15 illustrates that the entire extendable portion 1506 is housed within the housing 1524. The housing 1524 may have a hole into which the protrusion 1508 is attached or the protrusion 1508 may be integrally formed with the housing 1524, as illustrated in FIG. 15. In the illustrated example, the housing 1524 and the protrusion 1508 are integrally formed with the second plate 1504. FIG. 16 illustrates a housing 1524 on the second plate 1504 that surrounds the plunger 1516 and the extendable portion 1506, but does not extend laterally across the entire length or width of the second plate 1504 as the housing 1524 does in FIG. 15. Rather, the housing 1524 in FIG. 16 is more centrally located on the second plate 1504 and is designed to protect at least the extendable portion 1506. In FIG. 16, the protrusion 1508 is integrally formed with the housing 1524, which is also integrally formed with the second plate 1504 (i.e., all three components are integrally formed with each other). There is no requirement that the housing 1524, the plunger 1516, and the second plate 1504 are integrally formed. In alternative examples, one or more of the housing 1524, the plunger 1516, and the second plate 1504 may be separate, but permanently attached or selectively detachable components.

The first plate 1502 and the second plate 1504 may include any suitable materials including, but not limited to: carbon reinforced fiber, HDPE, PEBAX, polyurethane nylon, thermosetting polyurethane, and thermoplastic polyurethane (TPU). The extendable portion 1506 may include any suitable materials including, but not limited to, a soft TPU material, such as a TPU having a hardness rating of 80 A or below as measured on a Shore-A hardness scale. The plunger 1516 may include any suitable materials including, but not limited to, carbon reinforced fiber, HDPE, PEBAX, polyurethane nylon, thermosetting polyurethane, and TPU materials.

FIG. 16 illustrates a top plan view of another configuration of the traction element 1500. As briefly discussed above, the housing 1524 is positioned in approximately the center of the second plate 1504. The housing 1524 is a four-sided shape that extends away from the surface of the second plate 1504 in a direction out of the page from FIG. 16. The housing 1524 may have a smooth surface with rounded, beveled, or angled corners. The housing 1524 illustrated in FIG. 16 has a generally three-dimensional rectangular shape with rounded corners. If desired, the housing 1524 may generally function as a primary traction element.

FIG. 16 illustrates a retaining mechanism that retains the first plate 1502 in a position with respect to the second plate 1504. The retaining mechanism in this example has one or more holes 1534 defined within the second plate 1504 and corresponding posts 1536 that are provided with the first plate 1502. The posts 1536 are positioned to extend through the holes 1534 so that the first plate 1502 and the second plate 1504 are retained approximately parallel to and spaced apart from each other. Optionally, if desired, static (or primary) traction elements may be provided over the holes 1534, to prevent moisture, dirt, or debris from entering the shoe (and the posts 1536 may extend within the interior spaced provided in the static/primary traction elements).

Figure 17:
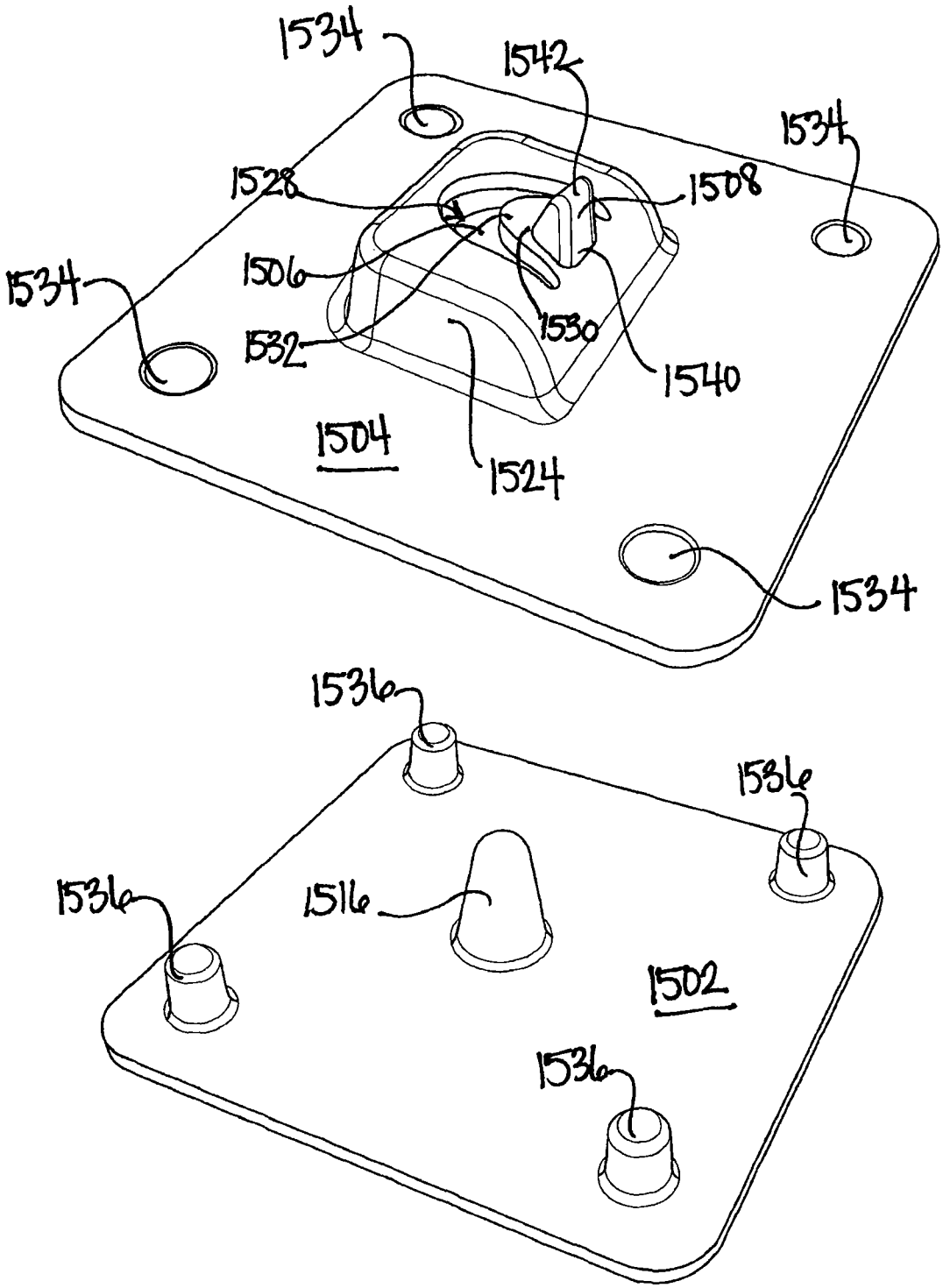
FIG. 17 illustrates an exploded view of the traction element illustrated in FIG. 15.

FIGS. 16 and 17 also illustrate a crescent-shaped cavity 1528 that defines an interior space 1530 of the crescent shape. The protrusion 1508 is positioned within the interior space 1530 of the crescent-shaped cavity 1528. At least a portion of the extendable portion 1506 comprises at least a portion of the floor and/or one or more walls of the crescent-shaped cavity 1528. This construction permits the crescent-shaped cavity 1528 to flex in response to a force applied by the plunger 1516. During this motion, the floor and walls flex and stretch in a direction out of the page from FIGS. 16 and 17. This motion causes a lip 1532 of the crescent-shaped cavity 1528 to extend in a curved or arced path. Since the protrusion 1508 is positioned within the interior space 1530 of this crescent-shaped cavity 1528, the protrusion 1508 also extends in a similar curved or arced motion or path. The path of the motion of the protrusion 1508 can be controlled by varying the shape of the cavity (and at least a portion of the extendable portion 1506).

The plunger 1516 may be positioned in any suitable location with respect to the extendable portion 1506 and/or the protrusion 1508. In any configuration, the plunger 1516 causes the extendable portion 1506 to flex, which causes the protrusion 1508 to extend in a particular direction. The plunger 1516, the extendable portion 1506, and the protrusion 1508 may be positioned in any configuration with respect to each other. However, as illustrated in FIG. 16, the protrusion 1508 and the extendable portion 1506 are spaced apart from each other on the second plate 1504 and the plunger 1516 applies a force to the second plate 1504 within the space between the extendable portion 1506 and the protrusion 1508, as will be described below.

FIG. 17 illustrates an exploded view of the traction element 1500 having a two plate configuration. The fraction element 1500 may comprise any number of plates. FIG. 17 illustrates the retaining mechanism, which includes four holes 1534 defined in the second plate 1504 and four posts 1536 proximate to the first plate 1502. The holes 1534 and the posts 1536 are positioned on their respective plates such that they are aligned with one another when the plates are positioned parallel to one another. The four holes 1534 are positioned in approximately the four corners of the square-shaped second plate 1504. The four posts 1536 are positioned in approximately the four corners of the square-shaped first plate 1502. The four posts 1536 may be attached to or integrally formed with the first plate 1502. In some examples, one or more primary traction elements 1518 may be attached to or integrally formed to cover one or more of the holes 1534 of the retaining mechanism on the second plate 1504.

FIG. 17 illustrates the plunger 1516 positioned in approximately the center of the first plate 1502. The plunger 1516 may be any suitable size and/or shape. In this example, the plunger 1516 is a cone-shape with a rounded top. Also illustrated in FIG. 17, the first plate 1502 and the second plate 1504 are approximately the same size and shape. In alternative examples, the first plate 1502 and the second plate 1504 are various sizes and shapes.

Figure 18:
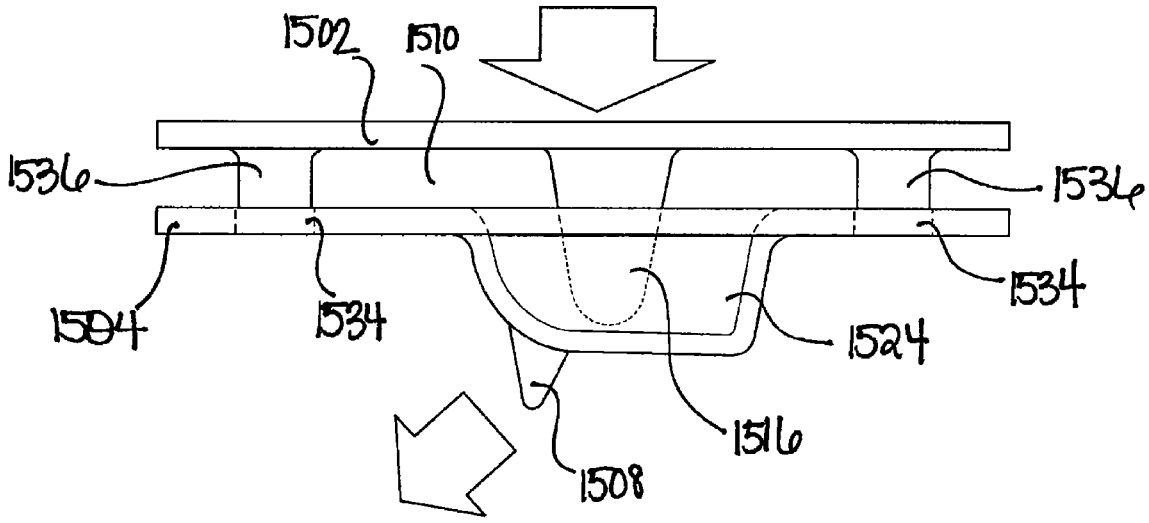
FIG. 18 illustrates a side view of a portion of the fraction element illustrated in FIG. 15.
Figure 19A:
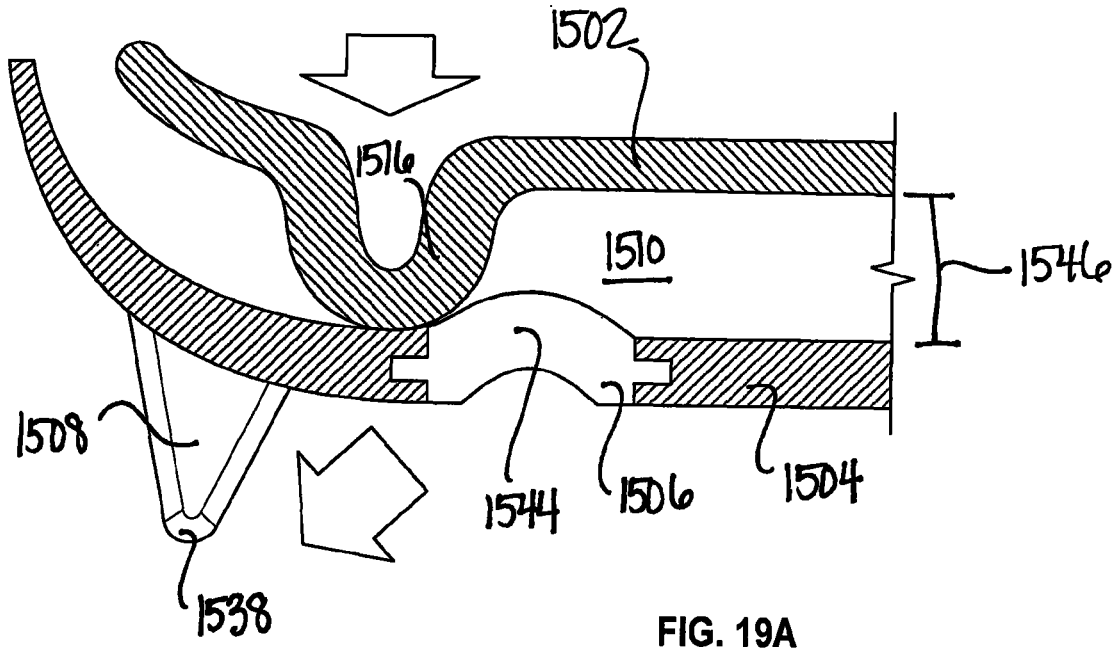
FIGS. 19A & 19B illustrate a cross-sectional view of a portion of the traction element illustrated in FIG. 15 in a retracted and an extended position, respectively.
Figure 19B:
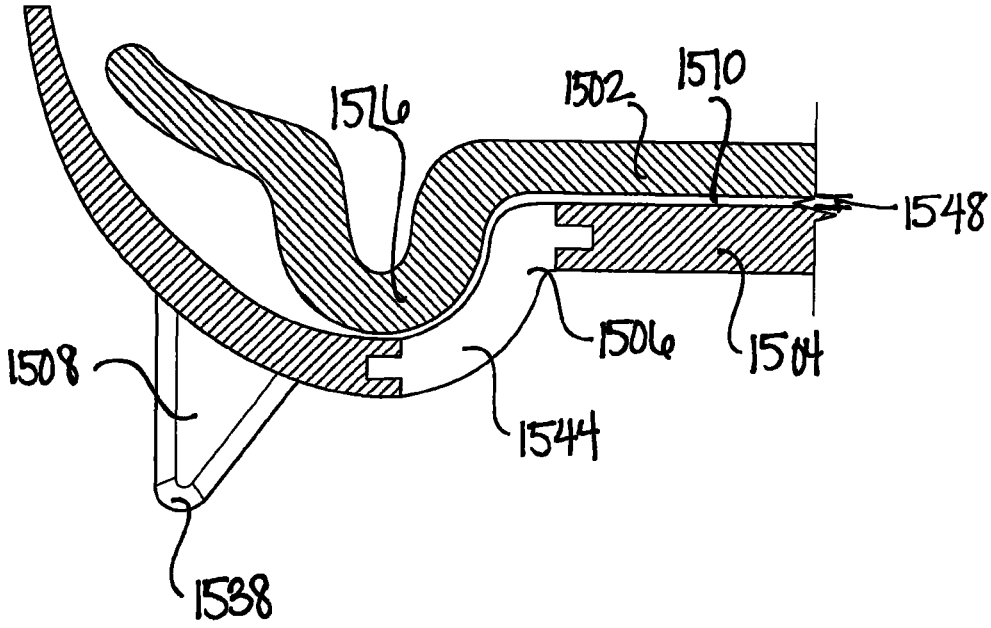

As illustrated in FIGS. 18, 19A, and 19B, the motion of the protrusion 1508 is angled with respect to the second plate 1504 (i.e., and thus the first plate 1502 since the first plate 1502 is positioned approximately parallel to the second plate 1504). More specifically, the angled motion can be straight or curved/arced. In the example constructions that are illustrated in FIGS. 15-18, 19A, and 19B, the configuration of the crescent-shaped cavity 1528 and the position of the extendable portion 1506 within the crescent-shaped cavity 1528 cause the protrusion's 1508 motion to be curved or arced with respect to the second plate 1504 (and thus the first plate 1502). Therefore, in the extended position, the tip 1538 of the protrusion 1508 will be "pointing" in a direction that creates an angle between the protrusion 1508 and the second plate 1504.

As illustrated in FIGS. 15-17, the protrusion 1508 is shaped as a polygon having two opposing square-shaped sides and two opposing triangular shaped sides. Together, this forms a tapered shaped from a first end 1540 of the protrusion 1508 that is proximate to the housing 1524 and the second plate 1504 toward a second end 1542 of the protrusion 1508 that is opposite the first end 1540. The second end 1542 is rounded. The protrusion 1508 may be any suitable shape and/or size.

Turning now to FIGS. 19A and 19B, the extendable portion 1506 is a bellows or other flexible or extensible structure 1544. A bellows structure 1544 may be included in any form in this construction. The bellows structure 1544 may include any component and may have any number of "bellows" or u-shaped/s-shaped elements. In the example structure illustrated in FIGS. 19A and 19B, the bellows structure 1544 is made up entirely of the extendable portion 1506. The bellows structure 1544 also defines at least part of the floor and/or at least part of the walls of the crescent-shaped cavity 1528 in the example configuration illustrated in FIGS. 19A and 19B.

As illustrated in FIGS. 19A and 19B, the first plate 1502 and the second plate 1504 of the traction element 1500 are positioned approximately parallel to one another and are spaced apart from one another. A space 1510 is defined between the two plates. The first plate 1502 and the second plate 1504 are spaced apart a first distance 1546 when the extendable portion 1506/bellows structure 1544 is in a first, retracted position. The first plate 1502 and the second plate 1504 are spaced apart a second distance 1548 when the extendable portion 1506/bellows structure 1544 is in a second, extended position. The first distance 1546 is greater than the second distance 1548. When the extendable portion 1506/bellows structure 1544 is flexed by a force, the distance between the first plate 1502 and the second plate 1504 is decreased. The force may be any force. In examples where these traction elements are incorporated into sole structures of footwear, the force is a force from a wearer's foot that is applied during use of the footwear.

FIGS. 19A and 19B illustrate the traction element 1500 in the retracted position and the extended position, respectively. The extendable portion 1506/bellows structure 1544 extends in a direction that is approximately 90° away from the surface of the second plate 1504. When a force is applied to the first plate 1502, the plunger 1516 applies a force to the extendable portion 1506/bellows structure 1544 and causes the extendable portion 1506/bellows structure 1544 to extend in a direction approximately 90° away from the surface of the second plate 1504. The extendable portion 1506/bellows structure 1544 may be configured to extend any desired amount. In this example, the extendable portion 1506/bellows structure 1544 extends up to 4 mm. The distance that the extendable portion 1506 extends corresponds to the distance between the first plate 1502 and the second plate 1504. The distance between the first plate 1502 and the second plate 1504 serves as a stopping mechanism for the extendable portion 1506/bellows structure 1544 so that it does not extend beyond a specified distance.

The bellows structure 1544 is u-shaped or s-shaped and is comprised entirely of the extendable portion 1506. In alternative examples, the bellows structure 1544 is not entirely comprised of the extendable portion 1506. The bellows structure 1544 is capable of flexing in response to a forced applied from the plunger 1516. The s-shape of the bellows structure 1544 serves as a kind of spring that receives the force from the plunger 1516 and uncurls into a straighter or "inside-out" form, as shown in FIG. 19B. In some examples, the bellows structure 1544 comprises two portions, a first portion and a second portion. The first portion may include a portion of the extendable portion 1506, as just described. The second portion may include a portion of the second plate 1504. The portion of the second plate 1504 that forms the second portion of the bellows structure 1544 may be flexible, but is not required to be flexible. In the examples where the portion of the second plate 1504 in the second portion of the bellows is flexible, that portion of the second plate 1504 also may be s-shaped or u-shaped and also may flex and "uncurl" when a force is applied to the extendable portion 1506 by the plunger 1516.

The bellows structure 1544 is designed to be any suitable extendable structure. For example, the bellows structure 1544 may include any number of "s-shapes," "u-shapes," "v-shapes," curves, or any other suitable extendable configuration. The bellows structure 1544 may be configured in any desired fashion. For example, the bellows structure 1544 may be positioned horizontally with respect to the second plate 1504, as shown in FIGS. 19A and 19B. The bellows structure 1544 may be made up entirely of the extendable portion 1506, as illustrated in FIGS. 19A and 19B. This portion of the extendable portion 1506 and/or the bellows structure 1544 is flexible and may be made of any suitable flexible material, such as a soft TPU with a hardness rating of 70 A-75 A on the Shore-A hardness scale.

Referring again to FIGS. 18, 19A, and 19B, the first plate and the second plate define a space 1510 therebetween. Within that space 1510 may be positioned a midsole. The midsole may comprise any suitable material, such as compressible foam. In other examples, the midsole may include one or more fluid-filled bladders. The midsole moderates the force applied to the first plate 1502 and may bias the plates of the traction element 1500 apart after the force has been removed or sufficiently relaxed. Alternatively, if desired, a spring mechanism or other biasing construction may be used to force the plates apart (back to their retracted positions) once the force is removed or sufficiently relaxed.

In some examples, the first and the second plate include a second plunger, a second extendable portion, and a second protrusion. The second set of plunger, extendable portion, and protrusion may be very similar in construction to the first set of plunger, extendable portion, and protrusion. For example, the second set may include a second bellows structure that is formed at least partially from the second extendable portion. The second set of plunger, extendable portion, and protrusion may operate discretely from the first set that is described above in FIGS. 15-19. Each set may receive at least a portion of the force that is applied to the first plate 1502. In some cases, only one of the sets receives a portion of the force. In other examples, both sets receive all of the force. Any number of sets of plunger and extendable portion may be included on a set of plates.

The traction elements also may include a pad that extends over at least a portion of the first plate. In this example, the force may be applied to the pad rather than the first plate directly.

Any example traction element described above may be incorporated into footwear. A sole structure may comprise a sole base member and one or more of any example embodiment of the traction elements described above. In some examples, the sole structure includes two or more of the traction elements describe above. Such sole structures may be included in an article of footwear. The article of footwear may include an upper and a sole structure attached thereto. At least one of any of the embodiments of the traction elements described above may be attached to the sole structure of this article of footwear. The sole structures and the footwear may include a pad that extends over at least a portion of the first plate of the traction elements, as described above. This pad may be a sockliner or other insole that is fitted within the space defined by the upper and the sole structure. The traction elements may be incorporated into any article of wear or article of manufacture.

The traction elements may be positioned in any suitable location on the sole structure. For example, one or more of any embodiment of the traction elements described above may be positioned within the forefoot and/or the heel region of the sole structure. The traction elements may be positioned along the medial and/or lateral edge of the forefoot region of the sole structure. Further, the traction elements may be positioned in the heel region of the footwear (e.g., to provide additional traction while backpedaling, etc.).

In the footwear examples, the space that is created between the first plate and the second plate, along with the force required to extend the extensible elements, provides an impact/force attenuating property to the traction elements described above. The force applied by the wearer's foot to the second plate is slowly absorbed by the motion of the first plate with respect to the lower plate, thus decreasing the intensity of the force. The shape and size of the second plate helps to moderate and "spread out" the pressure that the plunger may apply to the wearer's foot. A large second plate also helps to moderate and spread out the pressure that the plunger and other elements of the traction element may apply to the wearer's foot. Further, in the examples in which the plunger and/or any other portions of the traction element are integrally formed with the plates will also help to moderate the pressure that the wearer feels on his or her foot.

E. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. A traction element comprising:

a top plate having upper and lower sides;

a bottom plate having upper and lower sides, wherein the top plate lower side faces the bottom plate upper side and a separation is defined between the top plate lower side and the bottom plate upper side, and wherein the top plate is movable toward the bottom plate so as to reduce the separation; and a protrusion connected to and extending from the bottom plate lower side, and wherein movement of the top plate toward the bottom plate so as to reduce the separation causes extension of the protrusion relative to surrounding portions of the bottom plate lower side.

2. The traction element of claim 1, wherein movement of the top plate toward the bottom plate causes extension of the protrusion relative to surrounding portions of the bottom plate lower side in a direction that is approximately 90° relative to surrounding portions of the bottom plate lower side.

3. The traction element of claim 1, wherein movement of the top plate toward the bottom plate causes extension of the protrusion relative to surrounding portions of the bottom plate lower side in a direction that changes an angle of the protrusion relative to surrounding portions of the bottom plate lower side.

4. The traction element of claim 1, further comprising a plunger extending from the lower side of the top plate in a location aligned with the protrusion.

5. The traction element of claim 1, further comprising a plunger extending from the lower side of the top plate and a flexible portion attached to or integrally formed with the bottom plate, and wherein the protrusion is connected to the flexible portion, and the plunger is aligned with the protrusion.

6. The traction element of claim 1, further comprising a plunger extending from the lower side of the top plate and a flexible portion attached to or integrally formed with the bottom plate, and wherein the protrusion is connected to the flexible portion, and the plunger is aligned with the flexible portion and offset from the protrusion.

7. The traction element of claim 1, further comprising at least one static traction element extending from the lower side of the bottom plate.

8. The traction element of claim 1, further comprising a retaining mechanism configured to maintain an alignment of the bottom plate relative to the top plate when the top plate moves toward the bottom plate so as to reduce the separation.

9. The traction element of claim 1, further comprising a post extending from the lower side of the top plate and a receptacle in the bottom plate aligned with the post, wherein the post and the receptacle are configured to maintain an alignment of the bottom plate relative to the top plate when the top plate moves toward the bottom plate so as to reduce the separation.

10. The traction element of claim 9, further comprising a static traction element extending from the lower side of the bottom plate in a location corresponding to locations of the post and the receptacle.

11. The traction element of claim 1, wherein the top plate and the bottom plate are configured to remain parallel to one another when moving toward one another.

12. An article of footwear, comprising:

an upper;

a sole structure secured to the upper; and at least one traction element as recited in claim 1, wherein the at least one traction element is attached to the sole structure.

13. The article of footwear of claim 12, wherein the traction element is configured so that the top plate is movable toward the bottom plate, so as to reduce the separation, in response to force from a foot of a wearer of the article.

* * * * *